United States Patent [19]

Sakoda et al.

[11] Patent Number: 4,744,404

[45] Date of Patent: May 17, 1988

[54] FOUNDRY SAND BLOWING APPARATUS

[75] Inventors: Yutaka Sakoda; Akira Tumoto; Shigetoshi Nakano; Fujio Fujii, all of Hiroshima, Japan

[73] Assignee: Mazda Motor Corporation, Hiroshima, Japan

[21] Appl. No.: 66,343

[22] Filed: Jun. 25, 1987

[30] Foreign Application Priority Data

| | | | |
|---|---|---|---|
| Jun. 25, 1986 | [JP] | Japan | 61-150586 |
| Jun. 25, 1986 | [JP] | Japan | 61-150587 |
| Jun. 25, 1986 | [JP] | Japan | 61-150588 |
| Jun. 25, 1986 | [JP] | Japan | 61-150589 |
| Jun. 25, 1986 | [JP] | Japan | 61-150590 |
| Jun. 25, 1986 | [JP] | Japan | 61-150591 |
| Jun. 25, 1986 | [JP] | Japan | 61-97060[U] |

[51] Int. Cl.[4] ..... B22C 15/24

[52] U.S. Cl. ..... 164/180; 164/200; 164/186; 164/401

[58] Field of Search ..... 164/200, 201, 202, 401, 164/403, 180, 186, 213, 228

[56] References Cited

FOREIGN PATENT DOCUMENTS

| | | |
|---|---|---|
| 51-40251 | 10/1976 | Japan . |
| 52-12725 | 3/1977 | Japan . |
| 53-39692 | 9/1978 | Japan . |
| 56-66350 | 6/1981 | Japan . |
| 56-160636 | 11/1981 | Japan . |
| 57-36039 | 2/1982 | Japan . |
| 58-43848 | 3/1983 | Japan . |
| 60-5746 | 1/1985 | Japan . |
| 60-126249 | 8/1985 | Japan . |

*Primary Examiner*—Kuang Y. Lin

*Attorney, Agent, or Firm*—Gerald J. Ferguson, Jr.; Michael P. Hoffman; Michael J. Foycik, Jr.

[57] ABSTRACT

A foundry sand blowing apparatus for blowing foundry sand into a mold in forming a die such as a core for use in shell mold process or the like comprises a foundry sand storage tank provided with an eject pin. The eject pin is movable between an ejecting position in which it projects outside the storage tank through a sand discharge port provided in the tank to be aligned with the sand blowing port of the mold and a retracted position in which it is retracted from the sand blowing port into the tank. The tank is further provided with an eject pin driving mechanism for moving the eject pin to the ejecting position to eject the product away from the mold and to the retracted position.

15 Claims, 21 Drawing Sheets

FOUNDRY SAND BLOWING APPARATUS

BACKGROUND OF THE INVENTION

1. Field of the Invention

This invention relates to a foundry sand blowing apparatus for blowing foundry sand into a mold in forming a die such as a core for use in shell mold process or the like.

2. Description of the Prior Art

Generally a die such as a core is formed by blowing, under air pressure, foundry sand coated with foundry resin into a cavity of a split mold through a sand blowing port formed in a part of the mold, and heating the mold to melt the foundry resin to bind and set the foundry sand in a shape conforming to the shape of the cavity. In this method, the set product is removed from the mold by means of an eject pin. That is, since the product produced by such a method is held on the part of the mold in which the blowing port is formed when the mold is opened, the eject pin is inserted into the blowing port from outside the mold after the mold is opened to force out the product from the mold.

Conventionally, an apparatus for forming a core or the like in accordance with this method is provided, as disclosed in Japanese Unexamined Utility Model Publication No. 58(1983)-43848, with a blow station at which foundry sand stored in a foundry sand storage tank is blown into a mold (blowing step), and an ejection station at which a product is removed from the mold by operation of an eject pin (ejecting step).

However, the conventional apparatus is disadvantageous in that the mold must be reciprocated between the blow station and the eject station each time a product is formed, thereby increasing the cycle time by the time required for the reciprocation of the mold, and that the apparatus becomes cumbersome since both a blow station and an eject station must be provided.

Further, there has been known a sand blowing apparatus in which the foundry sand blown into the cavity of the mold is cured by curing catalyst gas introduced into the cavity as disclosed in Japanese Patent Publication No. 48(1973)-9246. (This method is generally referred to as the "cold-box method".) Also, in this apparatus, the mold must be reciprocated between the blow station and the eject station each time a product is formed. Further, in the cold-box type apparatus, there has been a problem that the curing catalyst gas cannot be permitted to leak outside since it is toxic and that if the curing catalyst gas is brought into contact with virgin sand in the sand storage tank, the sand is cured.

SUMMARY OF THE INVENTION

In view of the foregoing observations and description, the primary object of the present invention is to provide a foundry sand blowing apparatus which enables the blowing step and the ejecting step to be carried out at a single station, thereby eliminating the time required to reciprocate the mold, thereby shortening the cycle time, and making the apparatus for forming a die or the like compact.

Another object of the present invention is to provide a cold-box type foundry sand blowing apparatus in which the sand blowing step, the gassing step and the ejecting step can be carried out at a single station without conveying the mold from one station to another, and in which the curing catalyst gas can be prevented from polluting the environment and from being brought into contact with virgin foundry sand in the sand storage tank.

The foundry sand blowing apparatus in accordance with the present invention is characterized in that the foundry sand storage tank is provided with an eject pin movable between an ejecting position in which it projects outside the storage tank through a sand discharge port provided in the tank to be aligned with the sand blowing port of the mold and a retracted position in which it is retracted from the sand blowing port into the tank, and an eject pin driving means for moving the eject pin to the ejecting position to eject the product away from the mold and to the retracted position.

In the foundry sand blowing apparatus with this arrangement, by introducing pressurized air into the sand storage tank with the sand discharge port and the sand blowing port communicated with each other and the eject pin in the retracted position, the foundry sand in the storage tank is blown into the cavity of the mold, and by moving the eject pin to the ejecting position to project into the sand blowing port of the mold after the sand is hardened and the mold is opened, the product can be removed from the mold, whereby the blowing step and the ejecting step can be carried out at a single station without moving the mold from one station to another.

DESCRIPTION OF THE PREFERRED EMBODIMENTS

Figure 1:
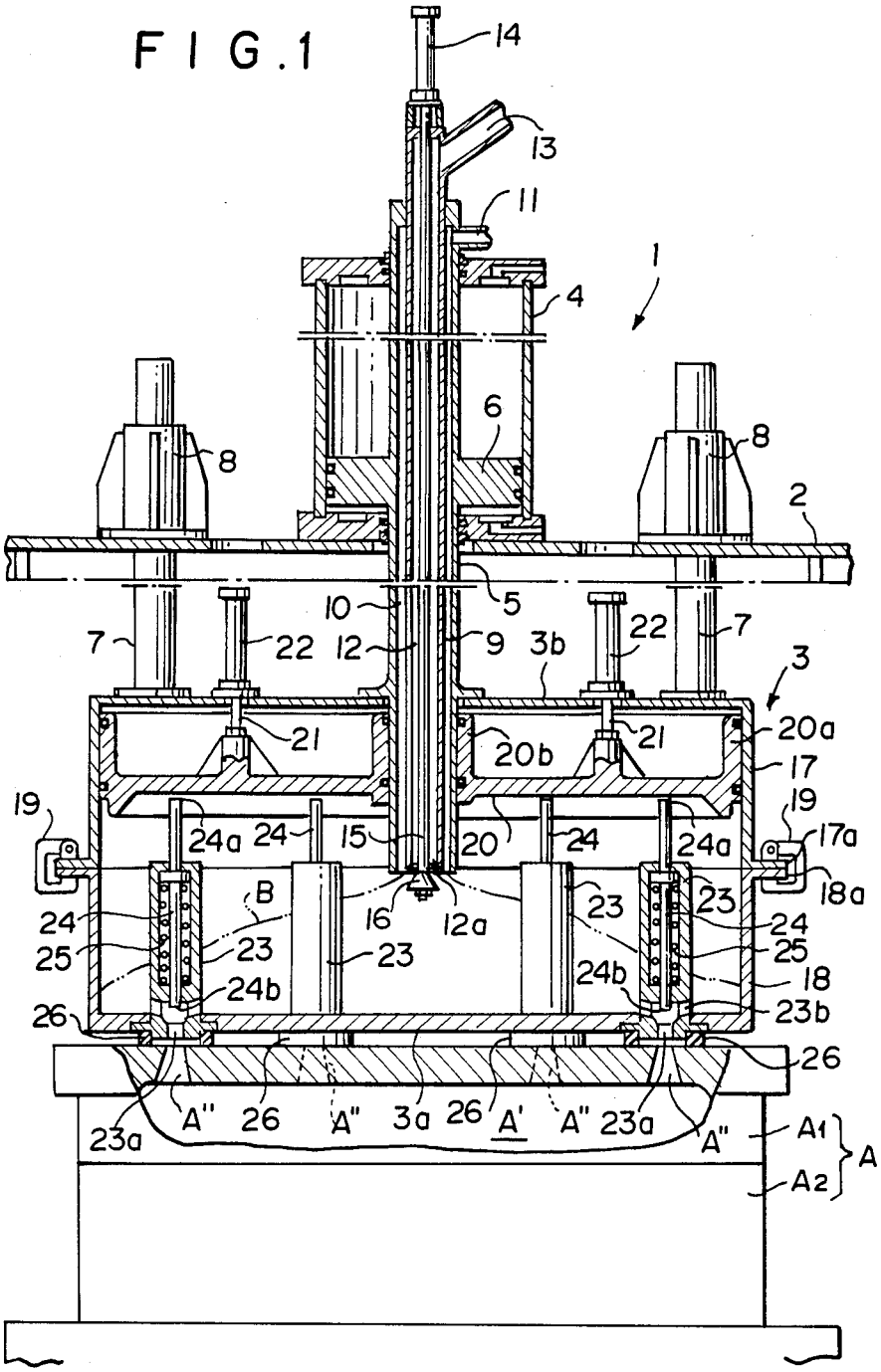
FIG. 1 is a cross-sectional view of a foundry sand blowing apparatus in accordance with a first embodiment of the present invention.

In FIG. 1, a foundry sand blowing apparatus 1 in accordance with an embodiment of the present invention comprises a sand storage tank 3 which is suspended from a frame 2 so that the lower wall 3*a* thereof is opposed to the upper surface of a mold A, and forms a blow head. The sand storage tank 3 is mounted on the lower end of a piston rod 5 projecting downward from a fluid pressure cylinder 4 mounted on the upper surface of the frame 2 and can thus be moved up and down between a lower position shown in FIG. 1 and an upper position shown in FIG. 2 by movement of a piston 6 to which the piston rod 5 is connected. A plurality of guide rods 7 are fixed to the upper wall 3*b* of the tank 3 and extend upwardly therefrom. The guide rods 7 are slidably fit into respective guide sleeves 8 fixedly mounted on the upper surface of the frame 2 to guide the up-and-down movement of the tank 3.

The piston rod 5 is a hollow tubular member and the lower end portion thereof projects into the tank 3 through the upper wall 3*a* of the tank 3. A pipe 9 extends longitudinally through the interior of the rod 5. The space between the outer surface of the pipe 9 and the inner surface of the rod 5 forms an air passage 10 communicated with the inner space of the tank 3. An air inlet 11 is formed on the upper end portion of the rod 5 to connect the air passage 10 with a pressurized air source (not shown). The inner space of the pipe 9 forms a sand passage 12 communicated with the inner space of the tank 3, and a sand inlet 13 is formed on the upper end portion of the pipe 9 to connect the sand passage 12 with a source of foundry sand B (not shown). A control valve 16 is provided on the lower end 12*a* of the sand passage 12 at which the sand passage 12 opens to the tank 3. The control valve 16 is connected to the lower end of a rod 15 which longitudinally extends through the pipe 9 and the upper end portion of which is received in a cylinder 14 mounted on the upper end of the pipe 9. The control valve 16 is moved up and down to close and open the sand passage 12 by the cylinder 14 by way of the rod 15, and when the control valve 16 opens the lower end 12*a* of the sand passage 12, the foundry sand B is supplied to the tank 3 through the sand passage 12.

The sand storage tank 3 comprises an upper half 17 open at the lower end and a lower half 18 open at the upper end. The upper and lower halves 17 and 18 are connected together by clamps 19 which clamp together flanges 17*a* and 18*a* respectively formed along the lower end of the upper half 17 and the upper end of the lower half 18.

A pressure plate 20 having an outer peripheral wall 20*a* and an inner peripheral wall 20*b* defining a central opening is received in the upper half 17 with the outer peripheral wall 20*a* being slidably fit in the inner peripheral surface of the upper half 17 and the inner peripheral wall 20*b* being slidably fit on the outer peripheral surface of the piston rod 5 projecting into the tank 3. On the upper wall 3*b* of the tank 3 are mounted eject cylinders 22 for moving the pressure plate 20 between an upper position shown in FIG. 1 and a lower position shown in FIG. 2 by way of piston rods 21.

A plurality of tubular members 23 are fixed to the bottom of the lower half 18 so as to extend through the bottom of the lower half 18 and project upward therefrom. Each of the tubular members 23 is provided with a sand discharge port 23*a* extending through the bottom of the lower half 18 to communicate the inner space of the tank 3 with the outside of the tank 3 by way of radial holes 23*b* formed in the tubular member 23 to radially extend along the upper surface of the bottom wall of the lower half 18. The foundry sand is blown into the cavity A' of the mold A through the radial holes 23*b* and the sand discharge port 23*a* of each tubular member 23. An eject pin 24 accomodated each tubular member 23 is slidable up and down between a retracted position shown in FIG. 1 and an ejecting position shown in FIG. 2. The eject pin 24 is normally held by a return spring 25 in the retracted position where the upper end portion 24*a* of the eject pin 24 projects upward beyond the upper end of the tubular member 23 to a position immediately below the pressure plate 20 and the lower end portion 24*b* is opposed to the sand discharge port 23*a* spaced upward therefrom. In the ejecting position, the lower end portion 24*b* of the eject pin 24 is inserted into the sand discharge port 23*a* and projects below the lower wall 3*a* of the tank 3.

The tubular members 23 are arranged to be aligned with sand blowing ports A" formed in the upper half A1 of the mold A. An annular elastic member 26 is fit on the portion of each tubular member 23 projecting downward outside the tank 3 so that the upper surface of the mold A is pressed against the lower wall 3*a* of the tank 3 by way of the elastic member 26, thereby sealing the junction of the sand discharge port 23*a* on the tank side and the sand blowing port A" on the mold side. The radial holes 23*b* communicated with the sand discharging port 23*a* of each tubular member 23 are inclined by a predetermined angle to facilitate discharge of the foundry sand B. The predetermined angle is selected so as not to permit the sand B to fall through sand discharge port 23*a* unless pressurized air is introduced into the tank 3 where the predetermined angle may be an angle of repose.

The operation of the apparatus in accordance with this embodiment will now be described.

First a desired amount of foundry sand B is introduced into the tank 3 through the sand passage 12, and then the cylinder 4 is operated to move the tank 3 to the lower position shown in FIG. 1, where the lower wall 3*a* of the tank 3 abuts against the upper surface of the mold A1 and the cavity A′ defined by the upper and lower halves A1 and A2 of the mold A is communicated with the inner space of the tank 3 by way of the radial holes 23*b* and the sand discharge port 23*a* of each tubular member 23 and the sand blowing port A″ aligned with each tubular member 23.

Thereafter, pressurized air is introduced into the tank 3 through the air passage 10, whereby the foundry sand B in the tank 3 is introduced into the cavity A′ under the air pressure to fill the cavity A′. Then the sand B is heated by way of the mold A and the foundry resin coated on the sand is melt to bind and set the foundry sand in a shape conforming to the shape of the cavity A′, the product D thus formed being a core in this particular embodiment.

Figure 2:
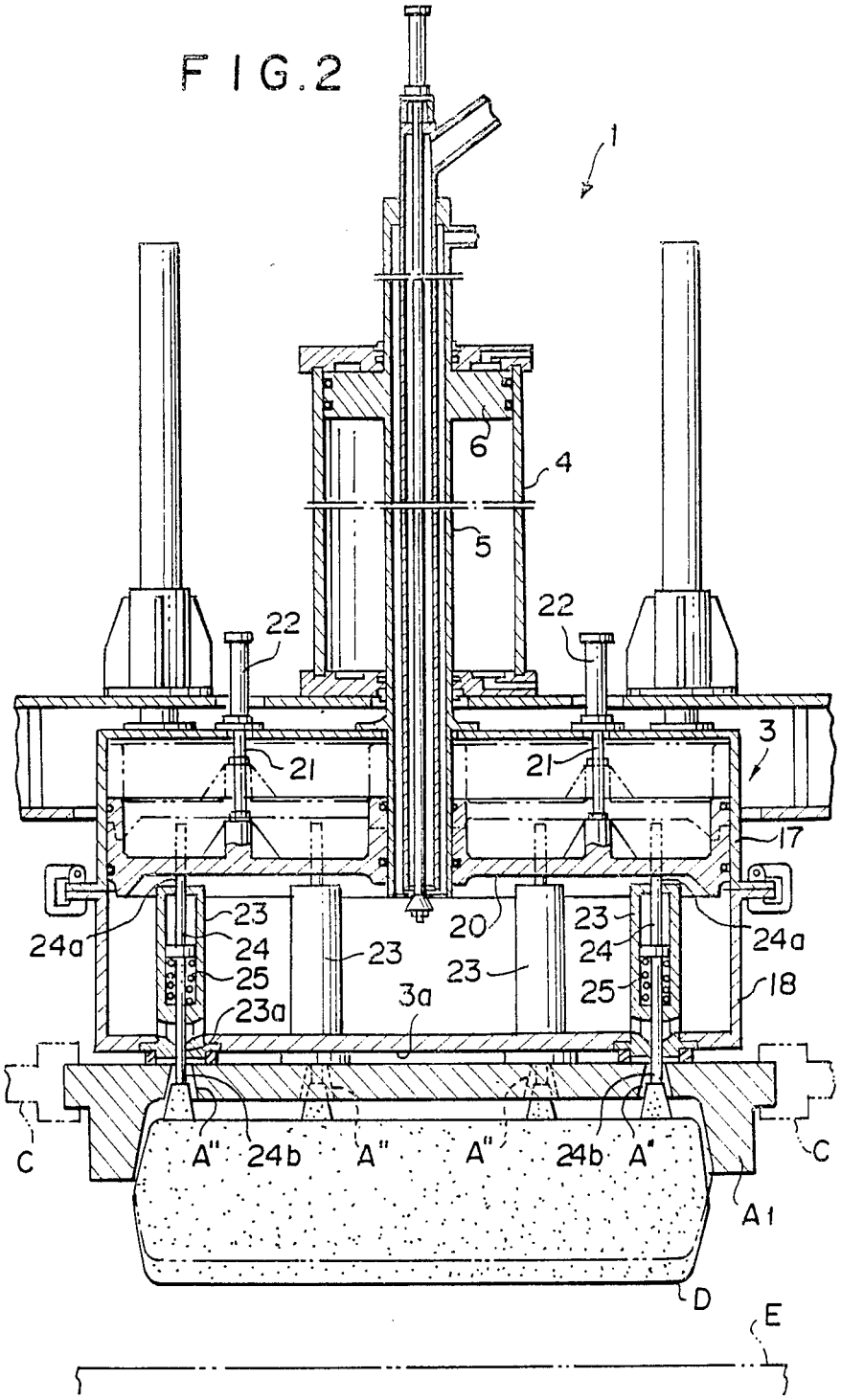
FIG. 2 is a cross-sectional view showing the foundry sand blowing apparatus of the first embodiment in a state different from the state shown in FIG. 1.

After the core D is thus formed in the mold A1 the cylinder 4 is operated to lift the sand tank 3 to the upper position as shown in FIG. 2. Then the upper half A1 of the mold A is lifted by separate lifters C to open the mold A. At this time, the core D formed in the mold A is lifted accompanying the upper half A1. When the upper surface of the upper half A1 again abuts against the lower wall 3*a* of the tank 3, the cylinders 22 are operated to drive downward the pressure plate 20 to the lower position shown by the solid line in FIG. 2 from the upper position shown by the chained line in FIG. 2 and shown by the solid line in FIG. 1, whereby the eject pins 24 are moved to the ejecting position overcoming the return springs 25 so that the lower end portions 24*b* are inserted into the sand blowing ports A″ of the upper half A1. Thus, the core D is ejected from the upper half A1 onto a receiving member E placed below the upper half A1.

As can be understood from the description above, in the apparatus 1 of this embodiment, the blowing step of blowing the foundry sand B into the cavity A′ of the mold A and the ejecting step of removing the product D from the mold A are carried out at a single station without conveying the mold A from one station to another.

Figure 3:
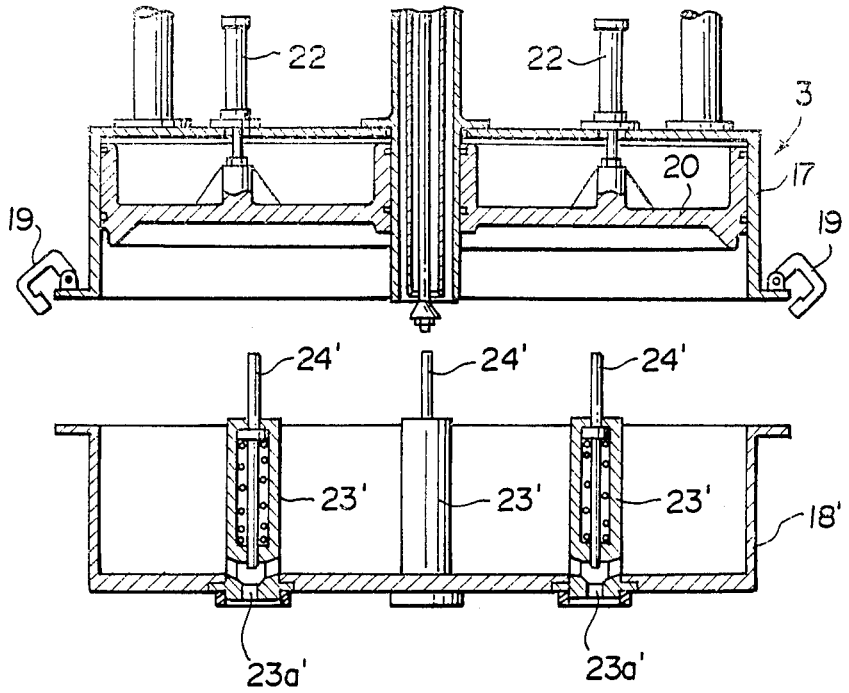
FIG. 3 is a fragmentary cross-sectional view for illustrating a feature of the sand storage tank employed in the first embodiment.

Further, in the embodiment described above, the sand storage tank 3 is separated into the upper and lower halves 17 and 18 and the sand discharge ports 23*a*, the eject pins 24 and the like are disposed in the lower half 18, while the pressure plate 20 and the cylinders 22 are disposed in the upper half 17 separated from the eject pins 24. Accordingly, change of the mold or change in the arrangement of the sand blowing ports of the mold can be accomplished by simply changing the lower half 18 of the tank 3 without changing the pressure plate 20 and the cylinders 22. For example, the apparatus 1 can be applied to a mold having three sand blowing ports by simply changing the lower half 18 to a lower half 18′ having three eject pins 24′ and three sand discharge ports 23*a*′ as shown in FIG. 3.

Figure 4:
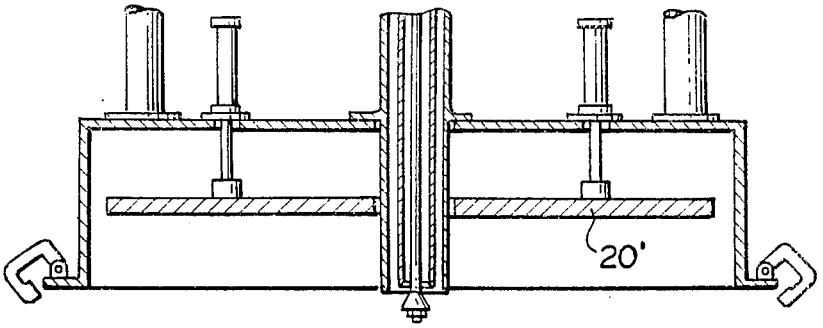
FIG. 4 is a fragmentary cross-sectional view showing a modification of the pressure plate employed in the first embodiment.

Though in the embodiment described above, the pressure plate 20 has the outer and inner peripheral walls 20*a* and 20*b*, and the peripheral walls 20*a* and 20*b* are adapted to be slid respectively on the inner surface of the upper half 17 and the outer surface of the piston rod 5 to guide the up-and-down movement of the pressure plate 20, the pressure plate may be a simple flat plate-like member as indicated at 20′ in FIG. 4 so long as it can be smoothly moved up and down.

Figure 5:
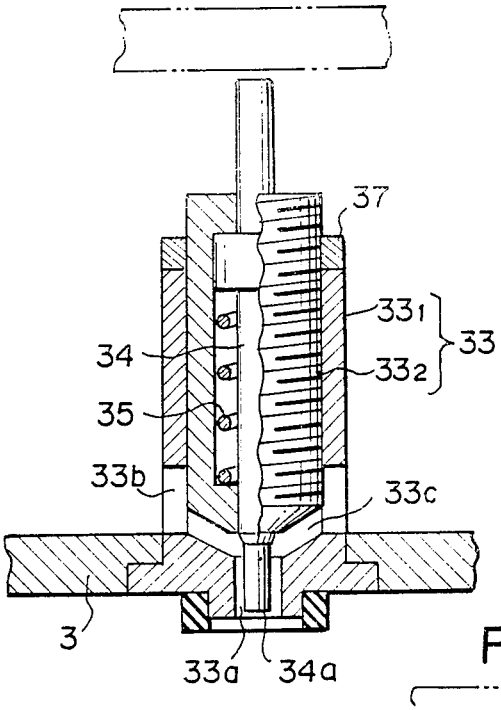
FIGS. 5 and 6 are enlarged cross-sectional views respectively showing modifications of the ejecting pin employed in the first embodiment.

FIG. 5 shows a modification of the eject pin. The eject pin 34 shown in FIG. 5 is supported by a tubular member 33 which is fixed to the bottom wall of the tank 3 and has a sand discharge port 33*a* and radial holes 33*b*. The tubular member 33 comprises an outer tubular member $33_1$ and an inner tubular member $33_2$. The inner tubular member $33_2$ is screwed into the outer tubular member $33_1$ to be movable with respect to the outer tubular member $33_1$, and is locked to the outer tubular member $33_1$ by a lock nut 37. The eject pin 34 is slidably supported by the inner tubular member $33_2$ and is urged upward by a return spring 35 accommodated in the inner tubular member $33_2$. The eject pin 34 is provided on the lower end thereof with a downward extension 34*a* projecting into the sand discharge port 33*a* even when the eject pin 34 is in the retracted position as shown in FIG. 5. The downward extension 34*a* has a diameter smaller than the diameter of the sand discharge port 33*a* and accordingly the foundry sand B is discharged through the space defined between the downward extension 34*a* and the inner surface of the discharge port 33*a*. This arrangement is advantageous in that the amount of sand which remains in the sand discharge port and can fall to the upper surface of the mold after the product is ejected and the tank 3 is moved upward away from the mold. Further, by adjusting the position of the inner tubular member $33_2$ with respect to the outer tubular member $33_1$, the effective cross-sectional area of the radial holes 33*b* or the passage 33*c* to the sand discharge port 33*a* when the eject pin 34 is in the retracted position can be changed according to the blowing condition of the sand.

Figure 6:
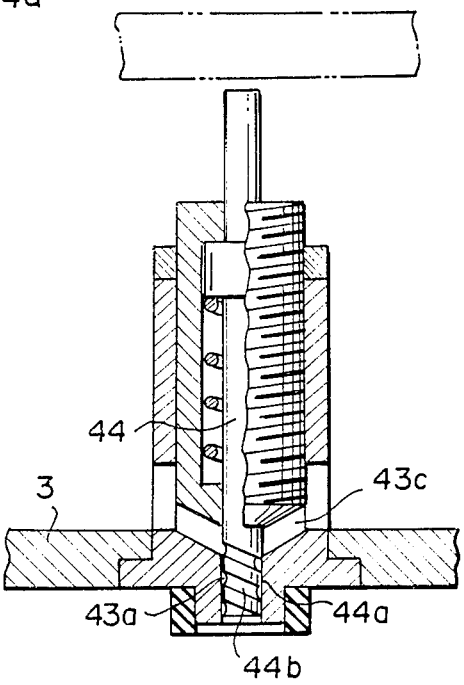

Another modification of the eject pin is shown in FIG. 6. The modification shown in FIG. 6 is very similar to that shown in FIG. 5, and accordingly, only the difference therebetween will described here. In this modification, the downward extension 44*a* of the eject pin 44 has a diameter substantially equal to that of the sand discharge port 43*a* and is fit into the sand discharge port 43*a*. The downward extension 44*a* is provided with a helical groove 44*b* and the foundry sand is discharged through the groove 44*b*.

A foundry sand blowing apparatus in accordance with another embodiment of the present invention will be described with reference to FIGS. 7 to 9, hereinbelow.

The apparatus 51 of this embodiment includes a carriage 54 having wheels 53 rolling on a pair of rails 52. A pair of vertical guide rods 56 fixed to a sand storage tank 55 on opposite sides thereof extend upward through the carriage 54, and a spring 57 is fit on the upper end portion of each guide rod 56 projecting beyond the upper surface of the carriage 54. Thus, the tank 55 is suspended from the carriage 54 to be movable up and down.

Projecting upward at the center of the upper surface of the tank 55 is a post portion 60 comprising an outer wall 58 and an inner wall 59. An air passage 61 for introducing pressurized air into the tank 55 is formed between the outer wall 58 and the inner wall 59, and a sand passage 62 for supplying foundry sand is formed inside the inner wall 59. A plurality of sand discharge ports 55*b* are formed in the lower wall 55*a* of the tank 55 to be aligned with sand blowing ports A" formed in the upper half A1 of the mold A. An annular elastic seal member 63 is fit on each of annular projections formed on the lower wall 55*a* of the tank 55 to circumscribe the sand discharge ports 55*b*.

A plurality of tubular members 64 are fixedly mounted on the upper wall of the tank 55 to be aligned with the respective sand discharge ports 55*b*. The lower end portion of each tubular member 64 projects into the tank 55, and an eject pin 65 is supported in each tubular member 64 to be movable up and down. The eject pin 65 is urged downward by a spring 66 disposed in the tubular member 64. The eject pin 65 is provided on the lower end thereof with a downward extension 65*a* projecting into the opposed sand discharge port 55*b* and having a diameter smaller than the diameter of the sand discharge port 55*b*. The upper ends of the respective eject pins 65 are connected to a connecting plate 67.

A frame 68 is provided above the carriage 54 and the tank 55, and a cylinder 69 is mounted on the frame 68 immediately above the post portion 60. A pressure member 72 is mounted on the lower end of a piston rod 71 connected to a piston 70 which is received in the cylinder 69. When the piston 70 is moved downward as shown in FIG. 7, the pressure member 72 pushes the tank 55 downward by way of the post portion 60 overcoming the force of the springs 57 so that the lower wall 55*a* of the tank 55 abuts against the upper surface of the mold A by way of the elastic seal members 63, and at the same time, an air passage 71*a* formed in the piston rod 71 is communicated with the air passage 61 in the post portion 60 by way of a passage 72*a* formed in the pressure member 72.

A plurality of L-shaped hooks 73 are suspended for swinging motion from the lower surface of the frame 68. Each of the hooks 73 is brought into engagement with the edge of the connecting plate 67 and released therefrom by a cylinder 74. Stoppers 75 are provided on the upper surface of the carriage 54 to limit downward movement of the connecting plate 67 when the hooks 73 are released from the connecting plate 67.

The operation of the apparatus of this embodiment will be described, hereinbelow.

Figure 7:
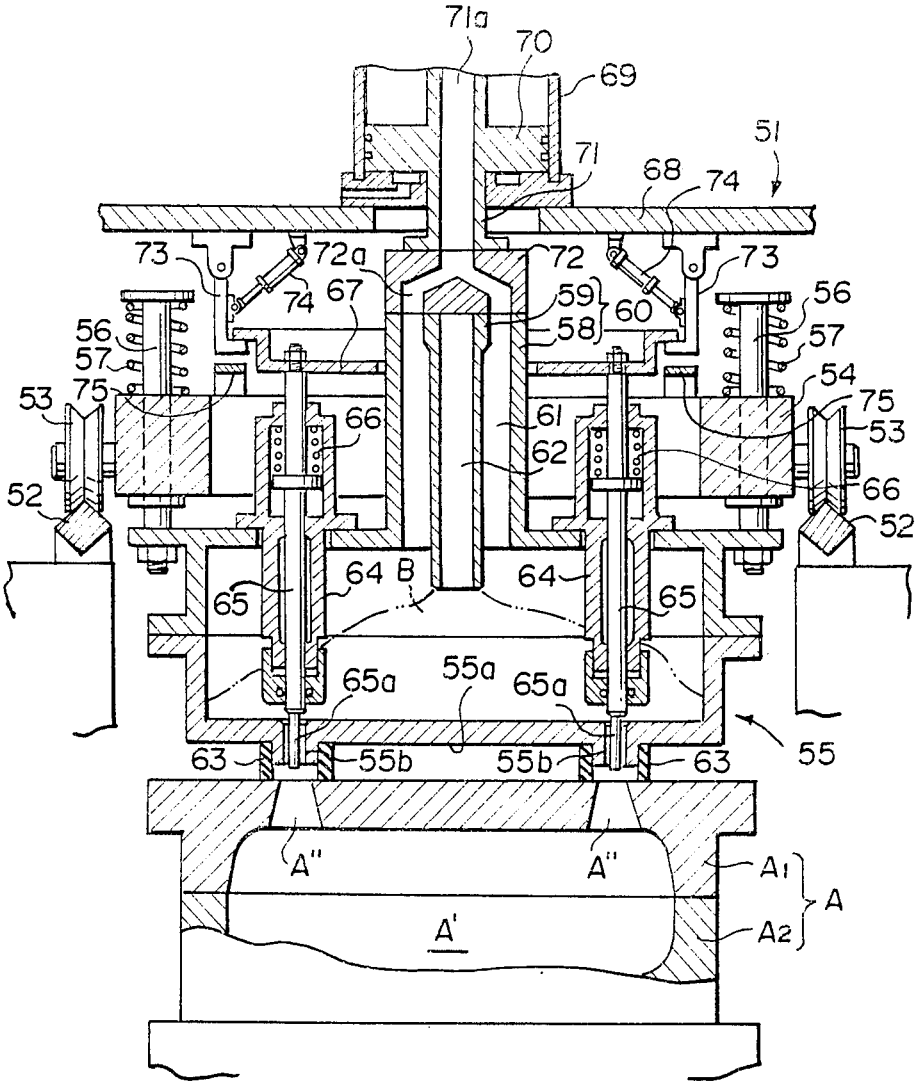
FIG. 7 is a cross-sectional view of a foundry sand blowing apparatus in accordance with a second embodiment of the present invention.

With the tank 55 filled with a desired amount of the foundry sand B as shown in FIG. 7, the tank 55 is moved downward by operation of the cylinder 69 so that the lower wall 55*a* of the tank 55 abuts against the upper surface of the mold A, whereby the sand discharge ports 55*b* of the tank 55 are respectively communicated with the sand blowing ports A" of the mold A. At this time, the hooks 73 are in engagement with the edge of the connecting plate 67 to limit downward movement of the connecting plate 67 and accordingly downward movement of the eject pins 65, whereby the eject pins 65 are held in an upper position relative to the tank 55 compressing the springs 66. Then, the foundry sand B is blown into the cavity A' of the mold A by way of the sand discharge ports 55*b* and the sand blowing ports A" by introducing pressurized air into the tank 55 by way of air passages 71*a*, 72*a* and 61.

Figure 8:
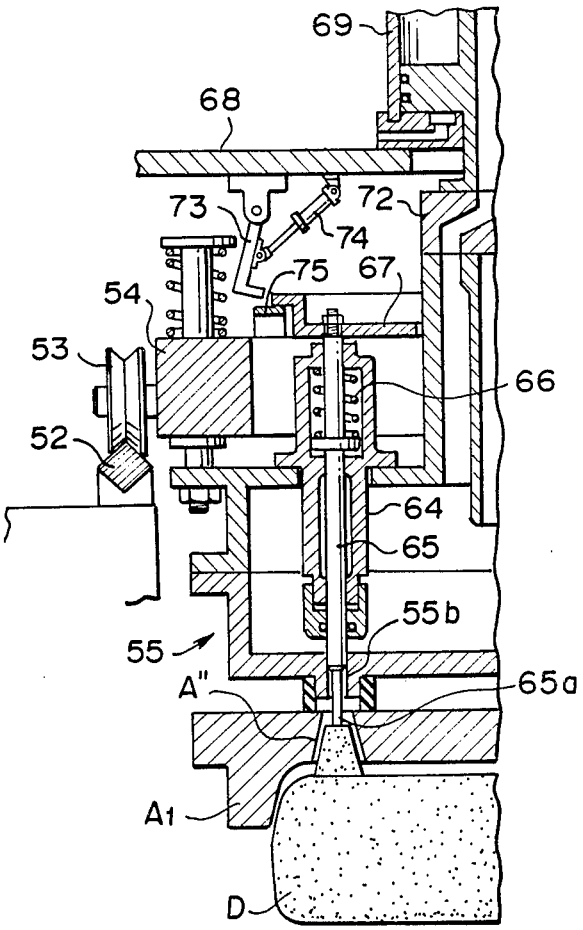
FIG. 8 is a cross-sectional view showing the foundry sand blowing apparatus of the second embodiment in a state different from the state shown in FIG. 7.
Figure 9:
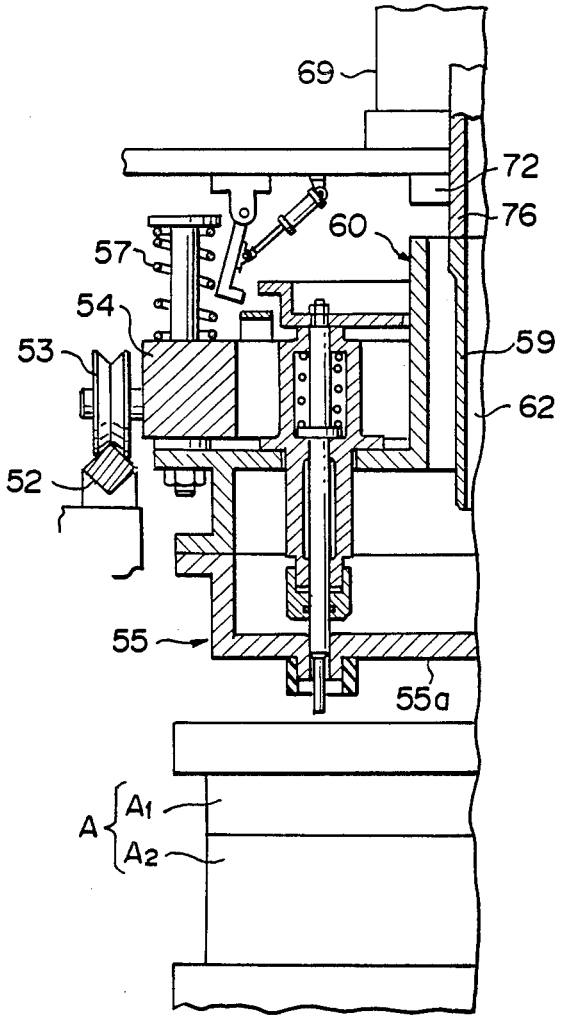
FIG. 9 is a cross-sectional view showing the foundry sand blowing apparatus of the second embodiment in another state different from the state shown in FIG. 7, FIGS. 10 to 12 are views similar to FIGS. 1 to 3 but for a sand blowing apparatus in accordance with a third embodiment of the present invention.

After the sand B in the cavity A' is bound and set, and the core D is formed in the mold A, the mold A is opened as shown in FIG. 8. In this particular embodiment, the mold A is opened by lowering the lower half A2 with the upper half A1 being held where it is. Thereafter, the cylinders 74 are operated to swing the hooks 73 outwardly and release them from the edge of the connecting plate 67, whereby the eject pins 65 are moved downward together with the connecting plate 67 under the force of the springs 66 until the connecting plate 67 abuts against the stoppers 75 so that the downward extensions 65*a* project into the respective sand blowing ports A" of the mold A through the sand discharge ports 55*b*. The core D is thus ejected from the upper half A1 of the mold A. Also in this embodiment, the blowing step of blowing the foundry sand B into the cavity A' of the mold A and the ejecting step of removing the product D from the mold A are carried out at a single station without conveying the mold A from one station to another.

In this particular embodiment, the tank 55 is replenished with the foundry sand B at a separate station. That is, when the pressure member 72 is moved upward away from the post portion 60 by operation of the cylinder 69 to release the downward pressure on the tank 55 as shown in FIG. 9, the tank 55 is moved upward relative to the carriage 54 under the force of the springs 57, and the lower wall 55*a* of the tank 55 is moved away from the upper surface of the mold A, thereby permitting the tank 55 to be moved along the rails 52 together with the carriage 54. After the tank 55 is thus moved to a replenishing station (not shown), a sand supply tube 76 is connected to the upper end of the sand passage 62 and foundry sand B is supplied to the tank 55 through the sand supply tube 76 and the sand passage 62.

Figure 10:
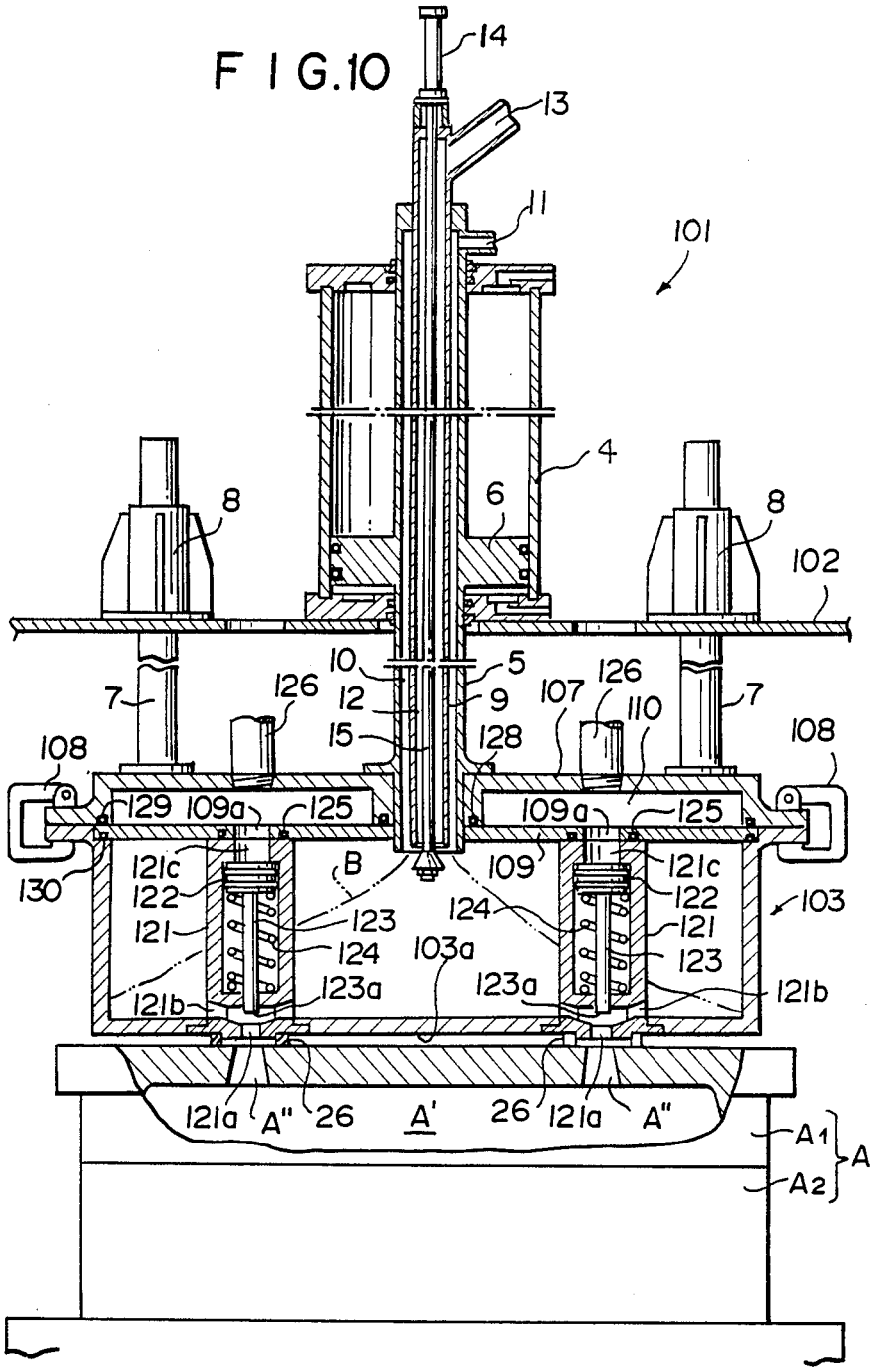
Figure 11:
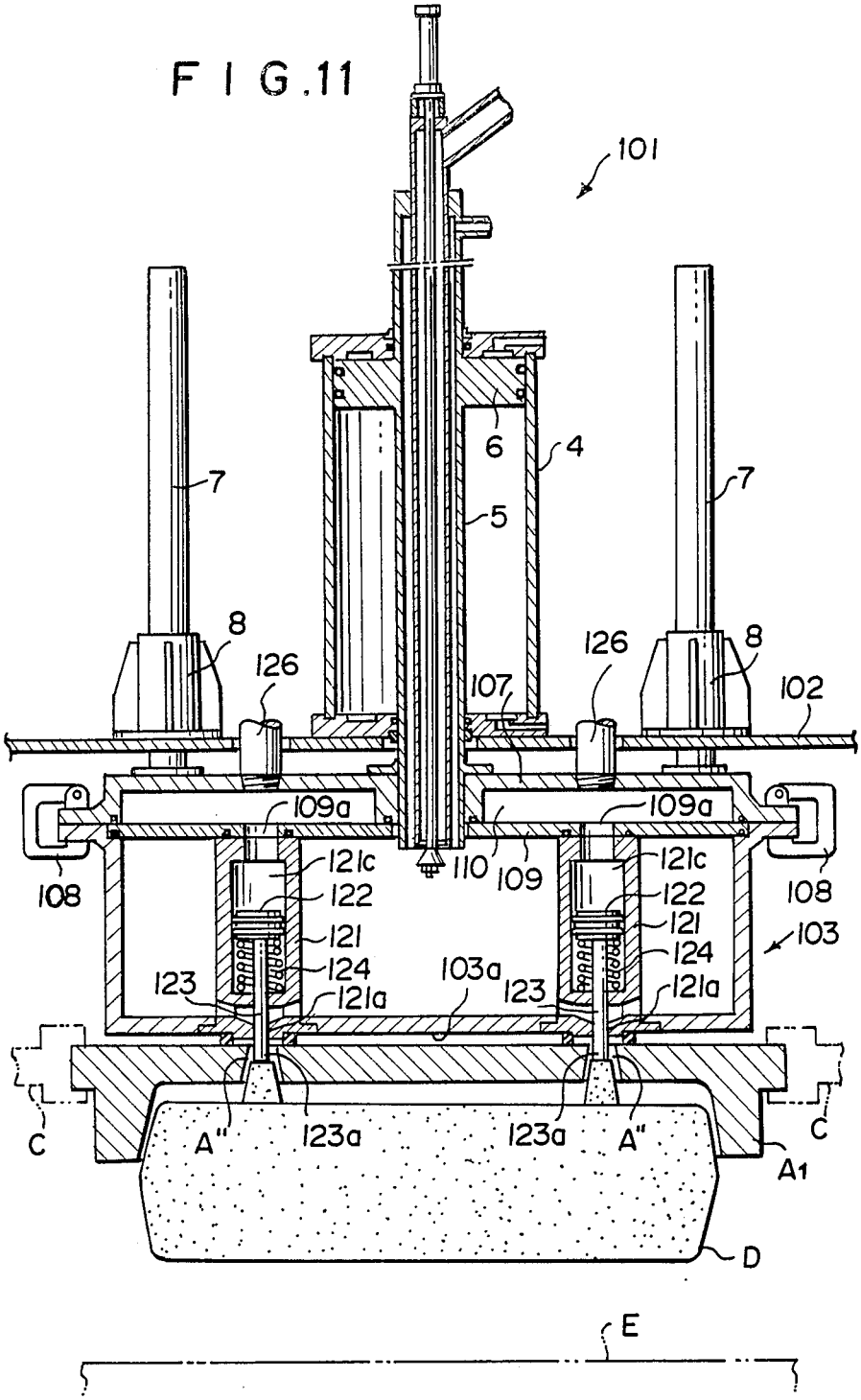
Figure 12:
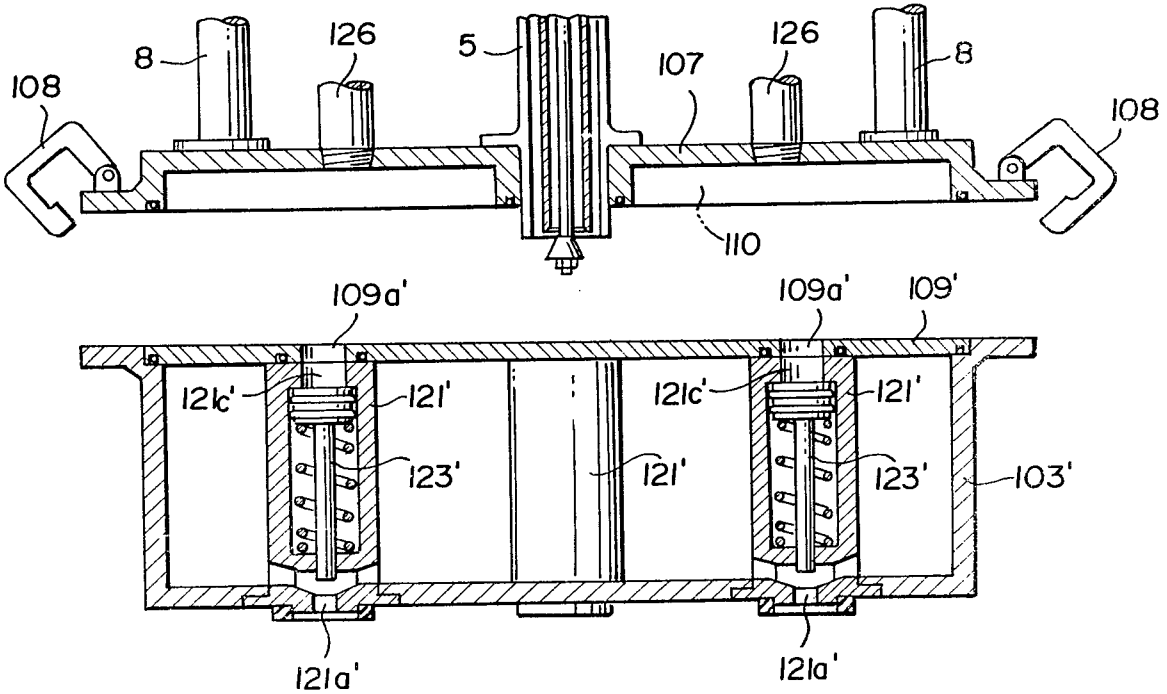

A sand blowing apparatus in accordance with another embodiment of the present invention will be described with reference to FIGS. 10 to 12, hereinbelow. Since the apparatus 101 of this embodiment mainly differs from the embodiment shown in FIGS. 1 and 2 in the structure of the product ejecting system, description will be mainly made on the product ejecting system, and the parts analogous to the parts shown in FIGS. 1 and 2 are given the same reference numerals and will not be described here.

A tank holder 107 is fixed to the lower end portion of the piston rod 5. A sand tank 103 is removably connected to the tank holder 107 by clamps 108. To the upper surface of the tank holder 107 are connected the guide rods 7. A partition wall 109 is disposed between the tank holder 107 and the tank 103 to define the upper wall of the tank 3 and to define in the tank holder 107 a space 110 separate from the tank 103.

A plurality of cylinders 121 are fixedly mounted on the bottom of the tank 103 to extend vertically. An opening 121*a* is formed on the lower end face of each cylinder 121 to form a sand discharge port. Further, further radial holes 121*b* are formed in the lower end portion of each cylinder 121 to communicate with the sand discharge port 121*a*. In the upper end portion of each cylinder 121 is slidably received a piston 122 and an eject pin 123 is connected to the piston 122 at the upper end. The eject pin 123 is urged upward by a spring 124 and is normally held in the retracted position shown in FIG. 10 where the lower end 123*a* of the eject pin 123 is opposed to the sand discharge ports 121*a* from above.

The upper end face of each cylinder 121 is pressed against the lower surface of the partition wall 109 by way of a seal ring 125 in an airtight fashion. A chamber 121*c* is formed in the cylinder 121 between the piston 122 and the lower surface of the partition wall 109 and the chamber 121*c* is communicated with the space 110 in the tank holder 107 by way of a communication hole 109*a* formed in the partition wall 109. Pressurized air is introduced into the space 110 through air supply pipes 126 mounted on the upper surface of the tank holder 107 and into the chambers 121c of the cylinders 121 to push downward the eject pins 123 overcoming the force of the springs 124, whereby the lower end portion 123a of each eject pin 123 is caused to project outside the tank 103 through the sand discharge port 121a. In order to ensure airtightness of the space 10 and the tank 103, the partition wall 109 is pressed against the tank holder 107 by way of seal rings 128 and 129, and against the tank 103 by way of seal rings 130.

In this embodiment, change of the mold or change in arrangement of sand blowing ports of the mold can be accomplished by changing the tank 103 with the partition wall 109. For example, the apparatus 101 can be applied to a mold having three sand blowing ports by simply changing the tank 103 to a tank 103' having three eject pins 123' and three sand discharge ports 121a' as shown in FIG. 12. In this case, pressurized air is introduced into all the chambers 121c' of the cylinders 121' through the space 110.

Still another embodiment of the present invention will be described hereinbelow with reference to FIGS. 13 and 14.

Figure 13:
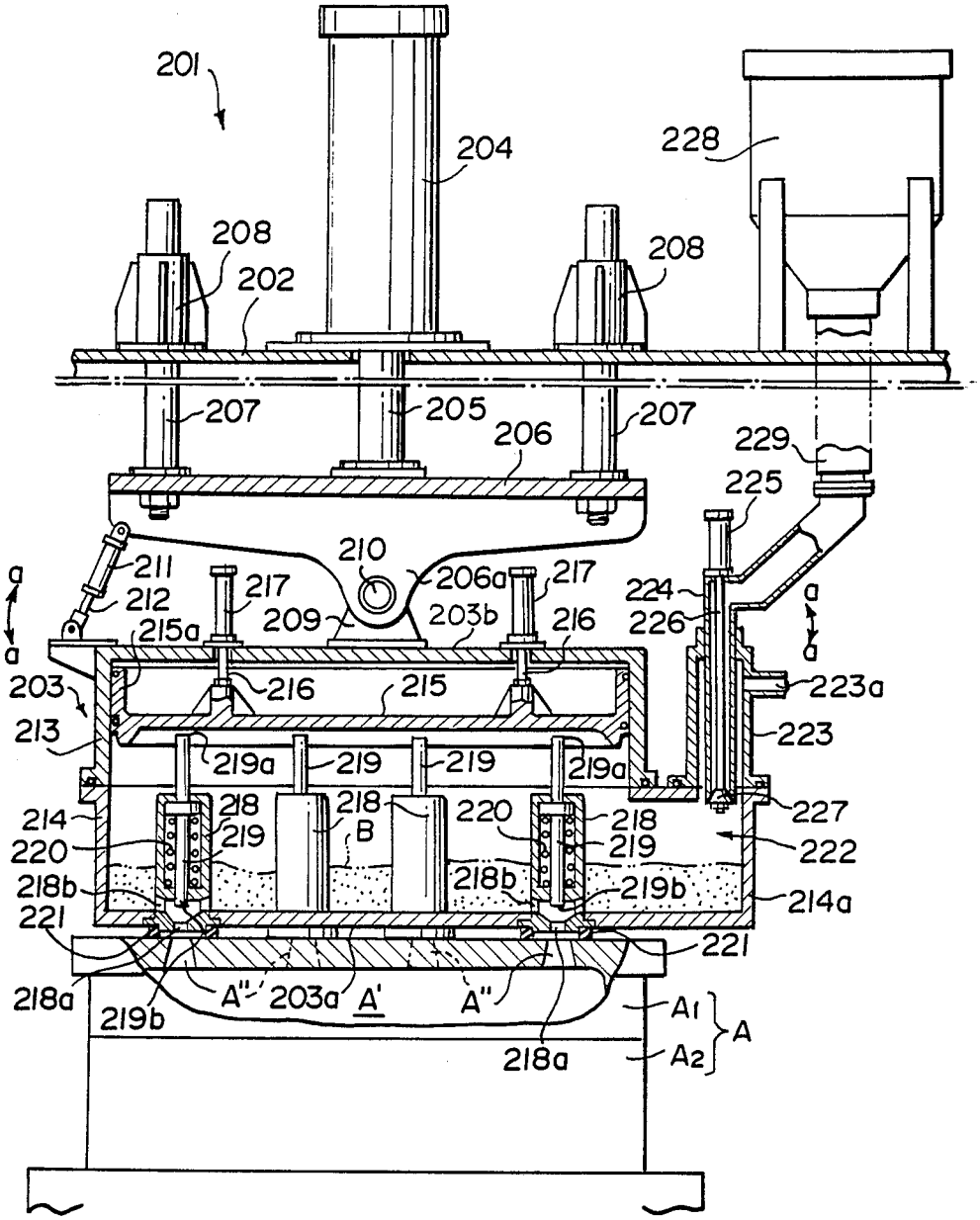
FIG. 13 is a cross-sectional view of a foundry sand blowing apparatus in accordance with a fourth embodiment of the present invention.

In FIG. 13, the foundry sand blowing apparatus 201 of this embodiment comprises a sand storage tank 203 which is suspended from a frame 202 so that the lower wall 203a thereof is opposed to the upper surface of a mold A, and forms a blow head. The sand storage tank 203 is mounted, by way of a support member 206, on the lower end of a piston rod 205 projecting downward from a fluid pressure cylinder 204 mounted on the upper surface of the frame 202 to be moved up and down between a lower position shown in FIG. 13 and an upper position shown in FIG. 14 in response to supply and removal of fluid pressure to and from the cylinder 204. A plurality of guide rods 207 are fixed to the upper surface of the support member 206 so as to extend upward near the edge thereof and the lower end of the piston rod 205 is connected to the upper surface of the support member 206 at the center. The guide rods 207 are slidably fit into respective guide sleeves 208 fixedly mounted on the upper surface of the frame 202 so that the support member 206 can be moved up and down while remaining horizontal. A bracket 209 is fixedly mounted on the upper wall 203b of the tank 203 at the center of the tank 203 and is connected to a downward extension 206a of the support member 206 by way of a pin 210 so that the tank 203 can be swung about the pin 210 in the direction of a—a. A cylinder 211 is connected to an end of the support member 206 and the free end of a piston rod 212 received in the cylinder 211 is connected to the corresponding end of the tank 203 so that the tank 203 is swung in response to extension and contraction of the piston rod 212.

The tank 203 comprises a holder portion 213 which is like a box open downward and is connected to the support member 206 by way of the bracket 209 and the pin 210, and a blow head portion 214 which is like a box open upward and is connected to the lower end of the holder portion 213. A pressure plate 215 having an outer peripheral wall 215a is received in the holder portion 213 with the outer peripheral wall 215a being slidably engaged with the inner surface of the holder portion 213. The pressure plate 215 is connected to a plurality of cylinders 217 by way of piston rods 216 to be moved up and down between an upper position shown in FIG. 13 and a lower position shown in FIG. 14.

A plurality of tubular members 218 are fixed to the bottom of the blow head portion 214 to extend through the bottom of the blow head portion 214 and project upward therefrom. Each of the tubular members 218 is provided with a sand discharge port 218a extending through the bottom of the blow head portion 214 to communicate the inner space of the tank 203 with the outside of the tank 203 by way of radial holes 218b formed in the tubular member 218 to radially extend along the upper surface of the bottom wall of the blow head portion 214. The foundry sand is blown into the cavity A' of the mold A through the radial hole 218b and the sand discharge port 218a of each tubular member 218. An eject pin 219 is inserted into each tubular member 218 and is slidable up and down between a retracted position shown in FIG. 13 and an ejecting position shown in FIG. 14. The eject pin 219 is normally held by a return spring 220 in the retracted position where the upper end portion 219a of the eject pin 219 projects upward beyond the upper end of the tubular member 218 to a position immediately below the pressure plate 215 and the lower end portion 219b is opposed to the sand discharge port 218a spaced upward therefrom. In the ejecting position, the lower end portion 219b of the eject pin 219 is inserted into the sand discharge port 218a so as to project below the lower wall 203a of the tank 203.

The tubular members 218 are arranged to be aligned with sand blowing ports A" formed in the upper half A1 of the mold A. An annular elastic member 221 is fit on the portion of each tubular member 218 projecting downward outside the tank 203 so that the upper surface of the mold A is pressed against the lower wall 203a of the tank 203 by way of the elastic members 221, thereby sealing the junction of the sand discharge ports 218a on the tank side and the sand blowing ports A" on the mold side. The radial holes 218b communicated with the sand discharging port 218a of each tubular member 218 are inclined by a predetermined angle to facilitate discharge of the foundry sand B. The predetermined angle is selected so as not to permit the sand B to fall through sand discharge port 218a unless pressurized air is introduced into the tank 203.

The blow head portion 214 is provided with a projecting portion 214a laterally projecting from one side thereof, and air and the foundry sand are introduced into the tank 203 through the space 222 in the projecting portion 214a. More specifically, an air introduction tube 223 is fixedly mounted on the upper surface of the projecting portion 214a. The air introduction tube 223 is provided with an air inlet 223a on one side of the upper end portion, and pressurized air from a pressurized air source (not shown) is introduced into the tank 203 through the inside of the air introduction tube 223 and the space 222 in the projecting portion 214a. A sand feed pipe 224 is inserted into the air introduction tube 223 to longitudinally extend through the tube 223 coaxially therewith. The lower end of the sand feed pipe 224 opens to the space 222 in the projecting portion 214a. A control valve 227 is provided on the lower end of the sand feed pipe 224. The control valve 227 is connected to the lower end of a rod 226 which longitudinally extends through the pipe 224 and the upper end portion of which is received in a cylinder 225 mounted on the upper end of the pipe 224. The control valve 227 is moved up and down to close and open the sand feed pipe 224 by the cylinder 225 by way of the rod 226, and when the control valve 227 opens the lower end of the pipe 224, the foundry sand B is supplied to the space 222 from a hopper 228 through a connecting tube 229 and the pipe 224. The connecting tube 229 should be flexible or expandable so as not to prevent up-and-down movement of the tank 203.

Now, the operation of the apparatus in accordance with this embodiment will be described, hereinbelow.

Assuming that a desired amount of foundry sand B is in the tank 203, the cylinder 204 is operated to move the tank 203 to the lower position shown in FIG. 13, where the lower wall 203*a* of the tank 203 abuts against the upper surface of the mold A, and the cavity A′ defined by the upper and lower halves A1 and A2 of the mold A is communicated with the inner space of the tank 203 by way of the radial holes 218*b* and the sand discharge port 218*a* of each tubular member 218 and the sand blowing port A″ aligned with each tubular member 218.

Thereafter, pressurized air is introduced into the tank 203 through the air introduction tube 223 and the space 222 in the projecting portion 214*a*, whereby the foundry sand B in the tank 203 is introduced into the cavity A′ under the air pressure to fill the cavity A′. Then the sand B is heated by way of the mold A and the foundry resin coated on the sand is melted to bind and set the foundry sand in a shape conforming to the shape of the cavity A′, the product D thus formed being a core in this particular embodiment.

Figure 14:
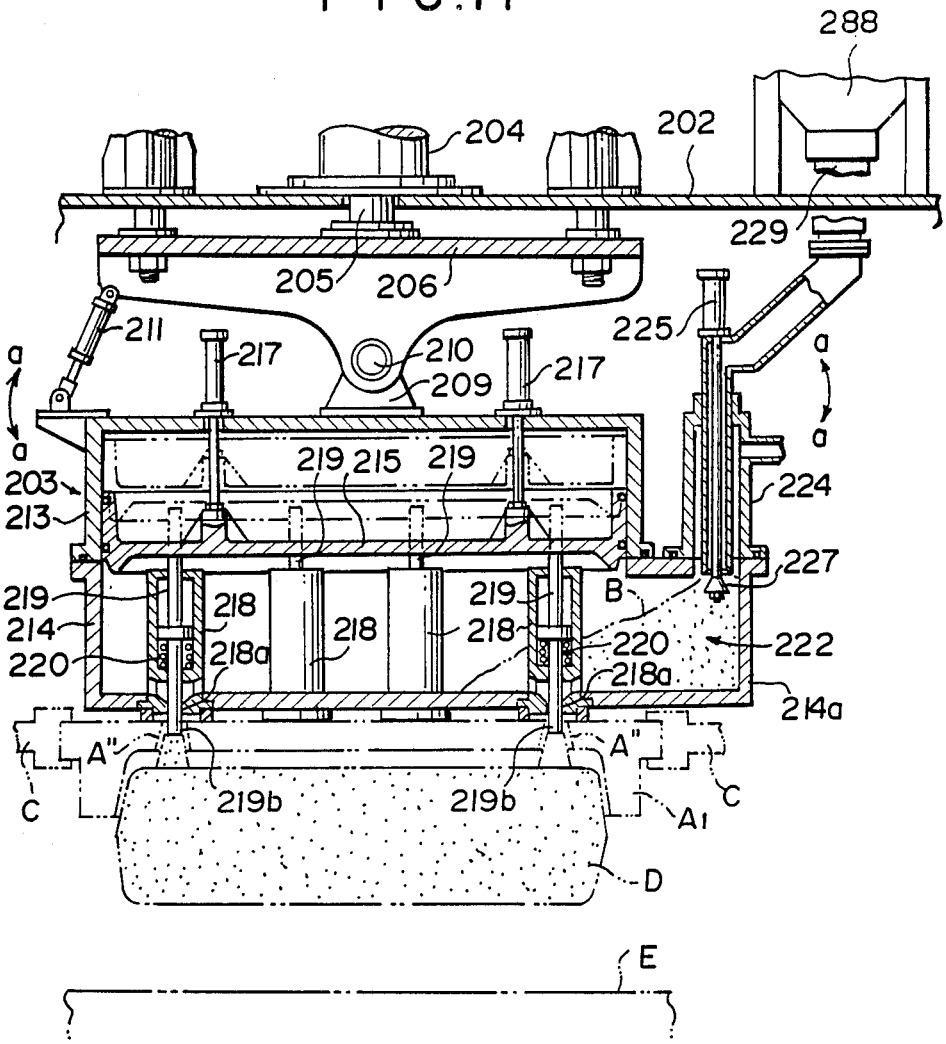
FIG. 14 is a cross-sectional view showing the foundry sand blowing apparatus of the fourth embodiment in a state different from the state shown in FIG. 13.

After the core D is thus formed in the mold A, the cylinder 204 is operated to lift the sand tank 203 by way of the piston rod 205 and the support member 206 to the upper position as shown in FIG. 14. Then tne upper half A1 of the mold A is lifted by separate lifters C to open the mold A. At this time, the core D formed in the mold A is lifted accompanying the upper half A1.

When the upper surface of the upper half A1 again abuts against the lower wall 203*a* of the tank 203, the cylinders 217 are operated to drive downward the pressure plate 215 to the lower position shown by the solid line in FIG. 14 from the upper position shown by the chained line in FIG. 14 and shown by the solid line in FIG. 13, whereby the eject pins 219 are moved to the ejecting position overcoming the force of the return springs 220 so that the lower end portions 219*b* are inserted into the sand blowing ports A″ of the upper half A1. Thus, the core D is ejected from the upper half A1 onto a receiving member E placed below the upper half A1.

Also in the apparatus of this embodiment, the blowing step of blowing the foundry sand B into the cavity A′ of the mold A and the ejecting step of removing the product D from the mold A are carried out at a single station without conveying the mold A from one station to another.

After one core D is formed, foundry sand B for forming another core must be supplied to the tank 203. By opening the sand feed pipe 224 by operating the cylinder 225 with the tank 203 in the upper position (with the upper half A1 of the mold A being lowered away from the tank 203), the foundry sand B is introduced into the tank 203 through the connecting tube 229 and the sand feed pipe 224 from the hopper 228.

Since the sand feed pipe 224 opens to the space 222 in the projecting portion 214*a* formed on one side of the tank 203, the foundry sand B introduced into the tank 203 through the sand feed pipe 224 is apt to concentrate in the space 222 as shown by the chained line in FIG. 14. In order to uniformly distribute the foundry sand B over the entire area of the bottom of the tank 203 as shown by the chained line in FIG. 13, the cylinder 211 is operated to swing the tank 203 about the pin 210.

The apparatus 201 of this embodiment is advantageous in that the sand discharge ports 218*a* and the eject pins 219 can be arranged solely depending upon the conditions of the cavity without taking into account interference with the sand supply mechanism.

By selecting the diameter of the lower end portion 219*b* of the each eject pin 219 so that the sand discharge port 218*a* is closed by the lower end portion 219*b* when the eject pin 219 is inserted into the sand discharge port 218*a*, the foundry sand B can be prevented from leaking through the sand discharge port 218*a* while the tank 203 is filled with the sand B or the tank 203 is swung.

In this embodiment, change of the mold or change in arrangement of sand blowing ports of the mold can be accomplished by simply changing the blow head portion 214.

Figure 15:
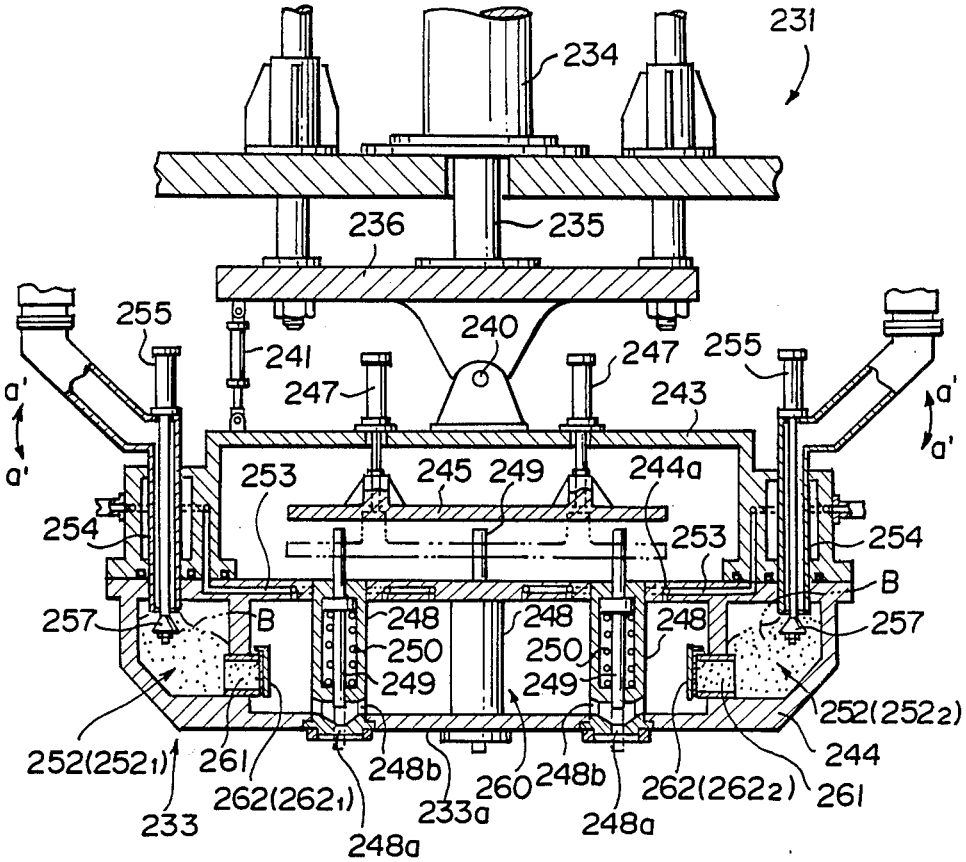
FIG. 15 is a cross-sectional view of a foundry sand blowing apparatus in accordance with a fifth embodiment of the present invention.

A sand blowing apparatus 231 in accordance with still another embodiment of the present invention shown in FIG. 15 is for forming a relatively large product and is provided with a pair of sand introduction spaces 252 formed on opposite sides of a blow head portion 244 of a tank 233. A sand feed pipe 254, a control valve 257 for closing and opening the lower end of the pipe 254 and a cylinder 255 for controlling the control valve 257 are provided for each sand introduction space 252.

In a blow space 260 in the blow head portion 244 are provided a plurality of tubular members 248. As in the preceding embodiment, each tubular member 248 is provided with a sand discharge port 248*a* and radial holes 248*b*, and an eject pin 249 and a return spring 250 are mounted in the tubular member 248. The blow head portion 244 is connected to a holder portion 243 in which a pressure plate 245 is received to be movable up and down by cylinders 247. Further the holder portion 243 is connected by way of a pin 240 to a support member 236 which is moved up and down by a cylinder 234 by way of a piston rod 235. The holder portion 243 is swung about the pin 236 in the direction of a′—a′ with respect to the support member 236 by a cylinder 241. A partition wall 244*a* is provided to separate the space in the blow head portion 244 from the space in the holder portion 243, and an air passage 253 for introducing pressurized air into the blow space 260 is formed through the side walls of the holder portion 243 and the partition wall 244*a*. Each introduction space 252 is communicated with the blow space 260 by way of a communicating passage 261. Each communicating passage 261 is provided at the inner end with a one-way valve 262 which is opened only toward the blow space 260 by gravity or the weight of the sand B.

In this embodiment, when the tank 233 is swung to lift the left side thereof after the sand introduction spaces 252 are filled with sand, the one-way valve $262_1$ for the left side communicating passage 261 is opened and the sand B in the left side sand introduction space $252_1$ flows into the blow space 260 (At this time, the sand B flowing to the blow space 260 is prevented from flowing into the right side sand introduction space $252_2$ through the flow space 260 since the one-way valve $262_2$ for the right side communicating passage 261 is closed.), and when the tank 233 is swung in the reverse direction, the sand B in the right side sand introduction space $252_2$ flows into the blow space 260. By repeatedly swinging the tank 233 back and forth, the sand B in the two sand introduction spaces 252 is fed into the blow space 260 and uniformly distributed throughout blow space 260. The one-way valves 262 also serve to prevent pressurized air introduced into the blow space 260 during the blowing step from entering the sand introduction spaces 252.

Though, in the embodiments described above, the foundry resin on the sand B blown into the cavity of the mold is thermoset, the present invention can also be applied to a so-called cold-box type sand blowing apparatus in which the sand blown into the cavity is set by curing catalyst gas.

Now referring to FIGS. 16 to 19, still another embodiment of the present invention in which the present invention is applied to a cold-box type sand blowing apparatus will be described.

Figure 16:
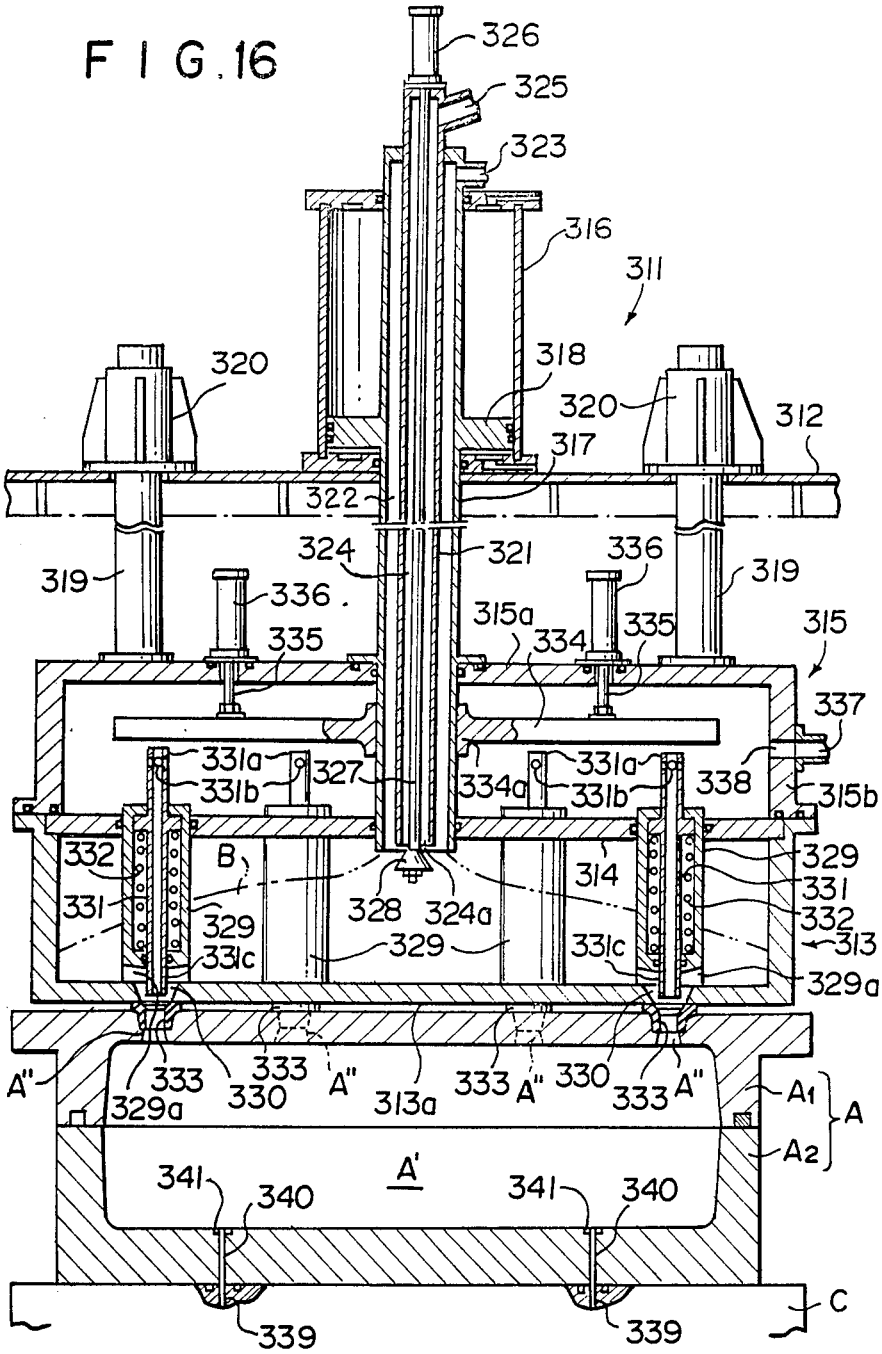
FIG. 16 is a cross-sectional view of a foundry sand blowing apparatus in accordance with a sixth embodiment of the present invention.
Figure 17:
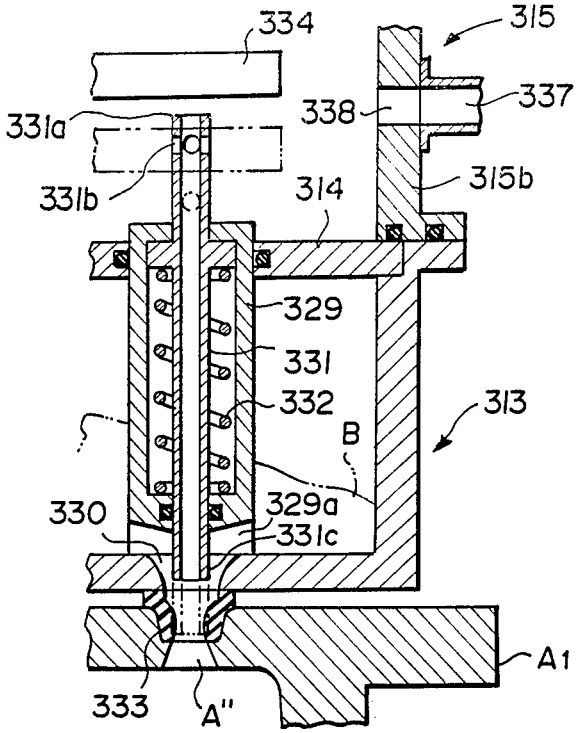
FIG. 17 is an enlarged fragmentary cross-sectional view showing a part of the apparatus of the sixth embodiment.

In FIG. 16, a sand blowing apparatus 311 of this embodiment comprises a sand storage tank 313 which is suspended from a frame 312 so that the lower wall 313*a* thereof is opposed to the upper surface of a mold A set below to form a blow head, and a gas introduction chamber 315 integrally provided on the tank 313 with a partition wall 314 intervening therebetween. The gas introduction chamber 315 is connected to the lower end of a piston rod 317 projecting downward from a fluid pressure cylinder 316 mounted on the upper surface of the frame 312 to be movable up and down between a lower position shown in FIG. 16 and an upper position in response to movement of a piston 318 to which the piston rod 317 is connected. A plurality of guide rods 319 are fixed to the upper wall 315*a* of the gas introduction chamber 315 so as to extend upward. The guide rods 319 are slidably fit into respective guide sleeves 320 fixedly mounted on the upper surface of the frame 312 to guide the up-and-down movement of the tank 313 and the gas introduction chamber 315.

The piston rod 317 is a hollow tubular member and the lower end portion thereof projects into the tank 313 through the gas introduction chamber 315 and the partition wall 314. A pipe 321 is inserted into the piston rod 317 and extends longitudinally through the rod 317. The space between the outer surface of the pipe 321 and the inner surface of the rod 317 forms an air passage 322 communicated with the inner space of the tank 313. An air inlet 323 is formed on the upper end portion of the rod 317 to connect the air passage 322 with a pressurized air source (not shown). The inner space of the pipe 321 forms a sand passage 324 communicated with the inner space of the tank 313, and a sand inlet 325 is formed on the upper end portion of the pipe 321 to connect the sand passage 324 with a source of foundry sand B mixed with binder (not shown). A control valve 328 is provided on the lower end 324*a* of the sand passage 324 at which the sand passage 324 opens to the tank 313. The control valve 328 is connected to the lower end of a rod 327 which longitudinally extends through the pipe 321 and the upper end portion of which is received in a cylinder 326 mounted on the upper end of the pipe 321. The control valve 328 is moved up and down to close and open the sand passage 324 by the cylinder 326 by way of the rod 327, and when the control valve 328 opens the lower end 324*a* of the sand passage 324, the foundry sand B is supplied to the tank 313 through the sand passage 324.

A plurality of tubular members 329 are fixed to the bottom of the tank 313 so as to project upward therefrom. Each of the tubular members 329 is provided with radial holes 329*a* communicated with a sand discharge port 330 formed through the bottom of the tank 313. A hollow tubular eject pin 331 is inserted into each tubular member 329 to be slidable up and down between a retracted position shown in FIG. 16 and an ejecting position a predetermined distance lower than the retracted position. The eject pin 331 is normally held by a return spring 332 in the retracted position where the upper end portion 331*a* of the eject pin 331 projects upward into the gas introduction chamber 315 and the lower end portion 331*c* projects into the sand discharge port 330 spaced from the wall portion defining the discharge port 330. The upper end portion 331*a* of the eject pin 331 is provided with a plurality of gas inlets 331*b* through which curing catalyst gas flows into the interior of the eject pin 331. In the ejecting position, the lower end portion 331*c* of the eject pin 331 is further inserted into the sand discharge port 330 to project below the lower wall 313*a* of the tank 313. The radial holes 329*a* communicated with the sand discharging port 330 of each tubular member 329 are inclined by a predetermined angle to facilitate discharge of the foundry sand B. The predetermined angle is selected so as not to permit the sand B to fall through sand discharge port 330 unless pressurized air is introduced into the tank 313.

The sand discharge ports 330 are arranged to be aligned with sand blowing ports A″ formed in the upper half A1 of the mold A. A plurality of annular elastic nozzle tips 333 are mounted on the lower surface 313*a* of the tank 313 to circumscribe the respective sand discharge ports 330. The tank 313 is pressed against the mold A with each nozzle tip 333 being compressed into the corresponding sand blowing port A″ of the mold A as clearly shown in FIG. 17, thereby sealing the junction between the sand discharge port 330 and the sand blowing port A″.

A pressure plate 334 having an inner peripheral wall 334*a* defining a central opening is received in the gas introduction chamber 315 with the inner peripheral wall 334*a* being slidably fit on the outer peripheral surface of the piston rod 317. On the upper wall 315*a* of the chamber 315 are mounted eject cylinders 336 for moving the pressure plate 334 between an upper position shown in FIG. 16 and a lower position shown in FIG. 18 by way of piston rods 335. Further, there is provided in the side wall 315*b* of the gas introduction chamber 315 a gas inlet 338 to which a gas hose 337 is connected to introduce the curing catalyst gas from a catalyst gas source (not shown) during a gassing step and pressurized air from a pressurized air source (not shown) during a sand blowing step.

The lower half A2 of the mold A is provided in the bottom wall thereof with gas discharge passages 340 for discharging the curing catalyst gas introduced into the cavity A′ to a suction passage 339 formed in the mold support table C. Each gas discharge passage 340 is provided at the upper end thereof with a vent plug 341 having a mesh member for preventing leakage of the foundry sand B through the gas discharge passage 340.

Now, the operation of the apparatus in accordance with this embodiment will be described, hereinbelow.

First a desired amount of foundry sand B is introduced into the tank 313 through the sand passage 324, and then the cylinder 316 is operated to move the tank 313 to the lower position shown in FIG. 16, where the lower wall 313*a* of the tank 313 abuts against the upper surface of the mold A, and the nozzle tips 333 are pressed against the sand blowing port A″, whereby the cavity A′ of the mold A is communicated with the inner space of the tank 313 by way of the radial holes 329*a* and the sand discharge port 330 of each tubular member 329, the nozzle tip 333 and the sand blowing port A" aligned with each tubular member 329.

Thereafter, pressurized air is introduced into the tank 313 through the air passage 322, whereby the foundry sand B in the tank 313 is introduced into the cavity A' under the air pressure to fill the cavity A'. At the same time, pressurized air is introduced into the gas introduction chamber 315 through the gas inlet 338 under a pressure at least equal to the pressure of the air introduced into the tank 313. The pressurized air introduced into the gas introduction chamber 315 flows into the tubular eject pins 331 and flows out from the lower end portions 331*c* thereof into the sand discharge ports 330, whereby flow of the sand B into the cavity A' is enhanced and the sand B is prevented from flowing into the lower end portions 331*c* of the eject pins 331 to block the lower end portions 331*c*. Then the cylinders 336 are operated to lower the pressure plate 334 to push downward the upper end portions 331*a* of the eject pins 331 overcoming the force of the return springs 332 so that the lower end portion 331*c* of each eject pin 331 is forced into the nozzle tip 333 which has been compressed into the corresponding sand blowing port A" of the mold A as shown by the chained line in FIG. 17, with the gas inlets 331*b* on the upper end portion 331*a* being in the gas introduction chamber 315. Then the curing catalyst gas is introduced into the gas introduction chamber 315 and thus injected into the cavity A', whereby the foundry sand B in the cavity A' is set in a shape conforming to the shape of the cavity A', the product E thus formed being a core in this particular embodiment. Since the nozzle tip 333 is of elastic material and is pressed against the sand blowing port A" under a high pressure so as to be in close contact with the sand blowing port A", the curing catalyst gas cannot leak outside between the nozzle tip 333 and the sand blowing port A". Further, since the outer peripheral surface of the lower end portion 331*c* of the eject pin 331 is in close contact with the compressed nozzle tip 333, the curing catalyst gas cannot flow into the tank 313 between the nozzle tip 333 and the eject pin 331. Accordingly, environmental pollution due to leakage of the curing catalyst gas can be prevented and the foundry sand stored in the tank 313 can be prevented from being brought into contact with the curing catalyst gas before being blown into the cavity A'.

Figure 18:
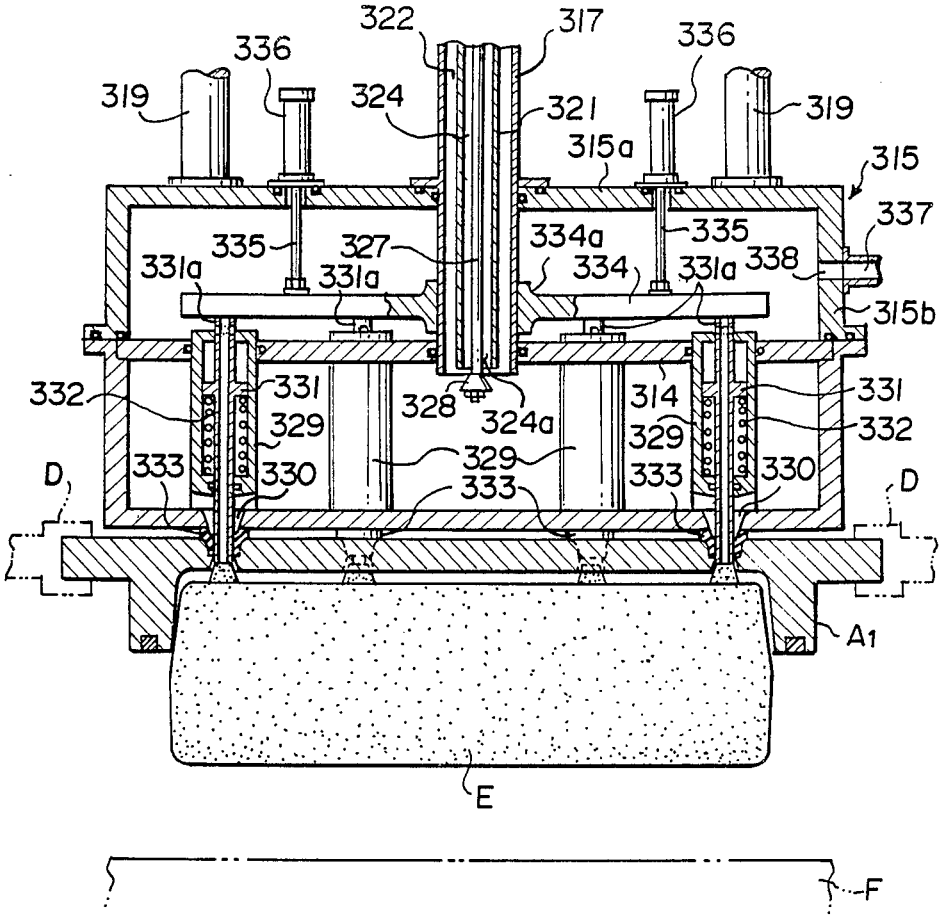
FIG. 18 is a fragmentary cross-sectional view showing the foundry sand blowing apparatus of the sixth embodiment in a state different from the state shown in FIG. 16.

After the core E is thus formed in the mold A, pressurized air is again introduced into the gas introduction chamber 315 through the gas inlet 338 to purge the curing catalyst gas in the gas introduction chamber 315, the cavity A' of the mold A and the like through the discharge passage 340 and the suction passage 339 into a neutralization tank (not shown). Thereafter, the cylinder 316 is operated to lift the sand tank 313 to the upper position as shown in FIG. 18. Then the upper half A1 of the mold A is lifted by separate lifters D to open the mold A. At this time, the core E formed in the mold A is lifted accompanying the upper half A1. When the upper surface of the upper half A1 again abuts against the lower wall 313*a* of the tank 313, the cylinders 336 are operated to drive downward the pressure plate 334 to a position lower than the position in which the curing catalyst gas is introduced into the cavity A', whereby the eject pins 331 are moved to the ejecting position where the lower end portions 331*c* are inserted into the sand blowing ports A" of the upper half A1. Thus, the core E is ejected from the upper half A1 onto a receiving member F placed below the upper half A1.

Figure 19:
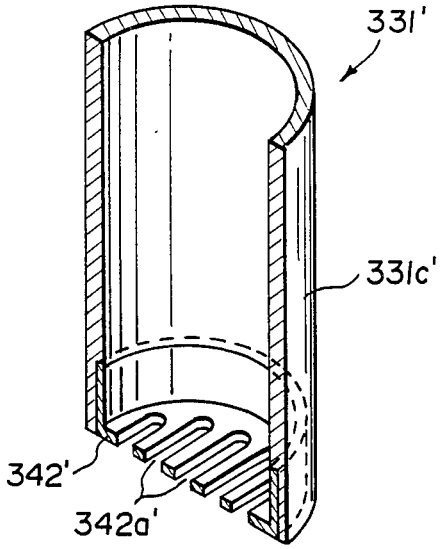
FIG. 19 is an enlarged cross-sectional view showing a modification of the tubular eject pin employed in the sixth embodiment.

If desired, a nozzle cap 342 having a plurality of slits 342*a* as shown in FIG. 19 may be attached to the lower end portion 331*c* of the eject pin 331 in order to more effectively prevent the foundry sand B from flowing into the eject pin 331 during the sand blowing step.

As can be understood from the description above, in the apparatus 311 of this embodiment, the blowing step of blowing the foundry sand B into the cavity A' of the mold A, the gassing step of introducing the curing catalyst gas into the cavity A' and the ejecting step of removing the product E from the mold A are carried out at a single station without conveying the mold A from one station to another. Further, the curing catalyst gas can be prevented from polluting the environment and from being brought into contact with the foundry sand in the sand storage tank.

Now referring to FIGS. 20 to 24, still another embodiment of the present invention in which the present invention is applied to a cold-box type sand blowing apparatus will be described.

Figure 20:
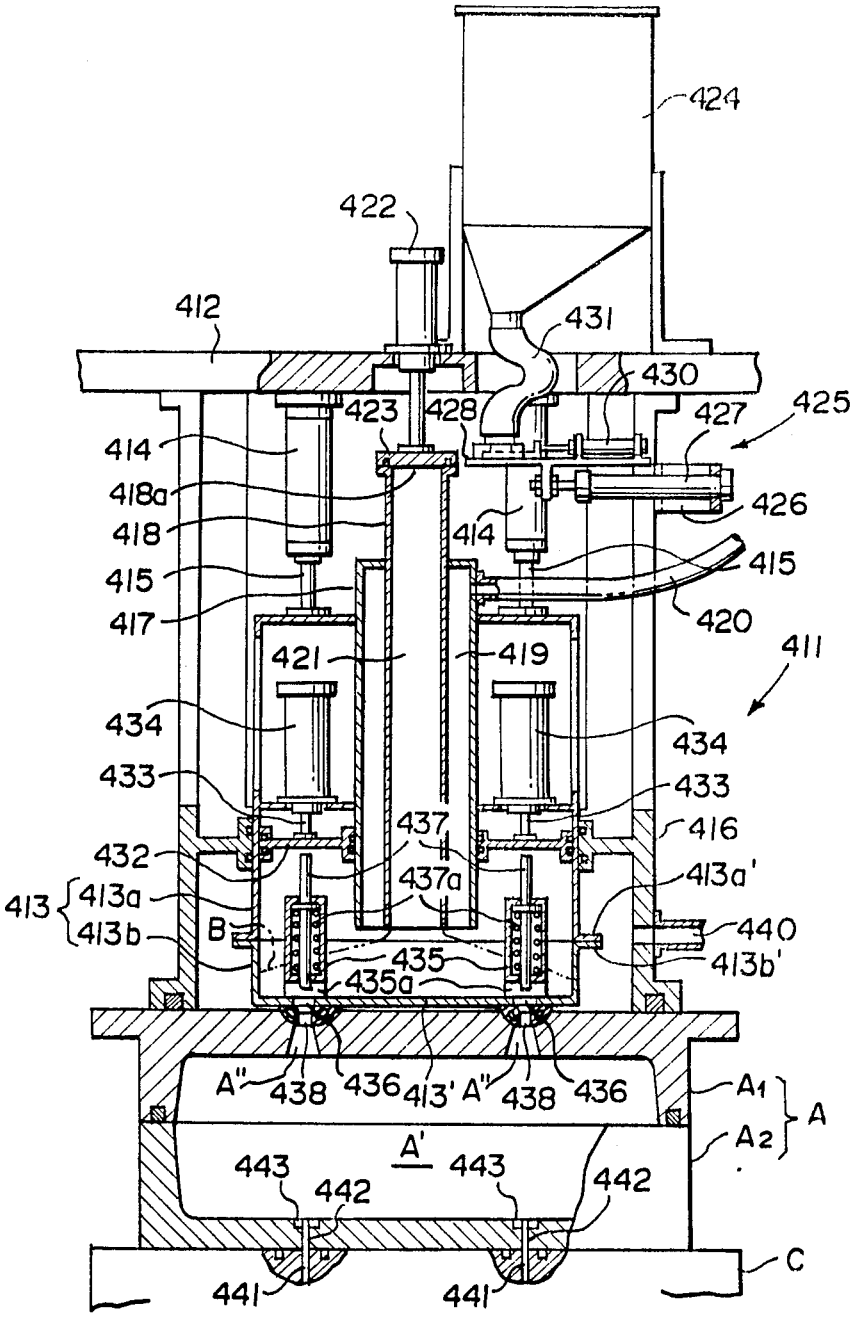
FIG. 20 is a cross-sectional view of a foundry sand blowing apparatus in accordance with a seventh embodiment of the present invention.

In FIG. 20, a sand blowing apparatus 411 of this embodiment comprises a sand storage tank 413 which is suspended from a frame 412 so that the lower wall 413' thereof is opposed to the upper surface of a mold A, and forms a blow head. The tank 413 is connected to the lower ends of piston rods 415 projecting downward from a pair of fluid pressure cylinders 416 mounted on the lower surface of the frame 412 so as to be movable up and down. The tank 413 is received for up-and-down sliding movement in a gassing case 416 fixedly suspended from the frame 412.

A pipe 417 is inserted into the tank 413 at the center thereof so as to extend through the upper wall of the tank 413 to a position near the bottom of the same. A pipe 418 is inserted into the pipe 417 so as to extend longitudinally through the pipe 417. The space between the outer surface of the pipe 418 and the inner surface of the pipe 417 forms an air passage 419 communicated with the inner space of the tank 413. An air supply tube 420 is connected to the upper end portion of the pipe 417 to connect the air passage 419 with a pressurized air source (not shown). The inner space of the pipe 418 forms a sand passage 421 communicated with the inner space of the tank 413. A valve body 423 is disposed above the upper open end 418*a* of the pipe 418 so as to be movable by a cylinder 422 between a closing position in which it is in close contact with the upper open end 418*a* to close the end 418*a* and a retracted position in which it is spaced from the upper open end 418*a* to open the same. With the valve body 423 in the retracted position, foundry sand B stored in a hopper 424 mounted on the frame 412 is introduced into the sand passage 421 from the upper open end 418*a* of the pipe 418 by a sand supply mechanism 425. As clearly shown in FIG. 23, the sand supply mechanism 425 comprises a cylinder 427 fixedly mounted on an upper side portion of the gassing case 416 by way of a bracket 426, a base plate 428 which is fixed to the free end of a piston rod 427*a* to be movable back and forth together with the piston rod 427*a* by the cylinder 427 between a sand supply position in which it is placed on the upper open end 418*a* of the pipe 418 and a retracted position in which it is away from the pipe 418, and a cylinder 430 which is fixed to the base plate 428 and drives a shutter 429 for opening and closing a sand supply opening 428*a* formed in the base plate 428. After the valve body 423 is moved to the retracted position, the cylinder 427 is operated to move the base plate 428 to the sand supply position in which the sand supply opening 428*a* is aligned with the upper open end 418*a* of the pipe 418. By subsequently operating the cylinder 430 to drive the shutter 429 to open the sand supply opening 428*a*, the foundry sand B in the hopper 424 is introduced into the tank 413 through the pipe 418.

The sand storage tank 413 comprises an upper half 413*a* open at the lower end and a lower half 413*b* open at the upper end. The upper and lower halves 413*a* and 413*b* are connected together by a suitable fastener such as bolts which clamp together flanges 413*a*' and 413*b*' respectively formed along the lower end of the upper half 413*a* and the upper end of the lower half 413*b*.

A pressure plate 432 having an outer peripheral wall and an inner peripheral wall defining a central opening is received in the upper half 413*a* with the outer peripheral wall being slidably fit in the inner peripheral surface of the upper half 413*a* and the inner peripheral wall being slidably fit on the outer peripheral surface of the pipe 417 projecting into the tank 413. Further, there are provided, in the upper half 413*a*, eject cylinders 434 for moving the pressure plate 432 between an upper position shown in FIG. 20 and a lower position shown in FIG. 21 by way of piston rods 433.

A plurality of tubular members 435 are fixed to the bottom of the lower half 413*b* so as to project upward therefrom. Each of the tubular members 435 is provided with radial holes 435*a* communicated with a sand discharge port 436 formed through the bottom of the tank 413. An eject pin 437 is inserted into each tubular member 435 to be slidable up and down between a retracted position shown in FIG. 20 and an ejecting position a predetermined distance lower than the retracted position. The eject pin 437 is normally held by a return spring 437*a* in the retracted position where the upper end portion of the eject pin 437 is positioned immediately below the pressure plate 432 and the lower end portion is opposed to the sand discharge port 436 from above.

The sand discharge ports 436 are arranged to be aligned with sand blowing ports A" formed in the upper half A1 of the mold A. A plurality of annular elastic blow tips 438 are mounted on the lower surface 413' of the tank 413 to circumscribe the respective sand discharge ports 330. The tank 413 is pressed against the mold A with each blow tip 438 being compressed into the corresponding sand blowing port A" of the mold A, thereby sealing the junction between the sand discharge port 436 and the sand blowing port A". The blow tip 438 is hollow and the inner diameter of the blow tip 438 is selected so that the inner peripheral surface of the blow tip 438 is brought into close contact with the outer peripheral surface of the eject pin 437 when the lower end portion of the eject pin 437 is inserted into the blow tip 438 as shown in FIG. 21.

Figure 21:
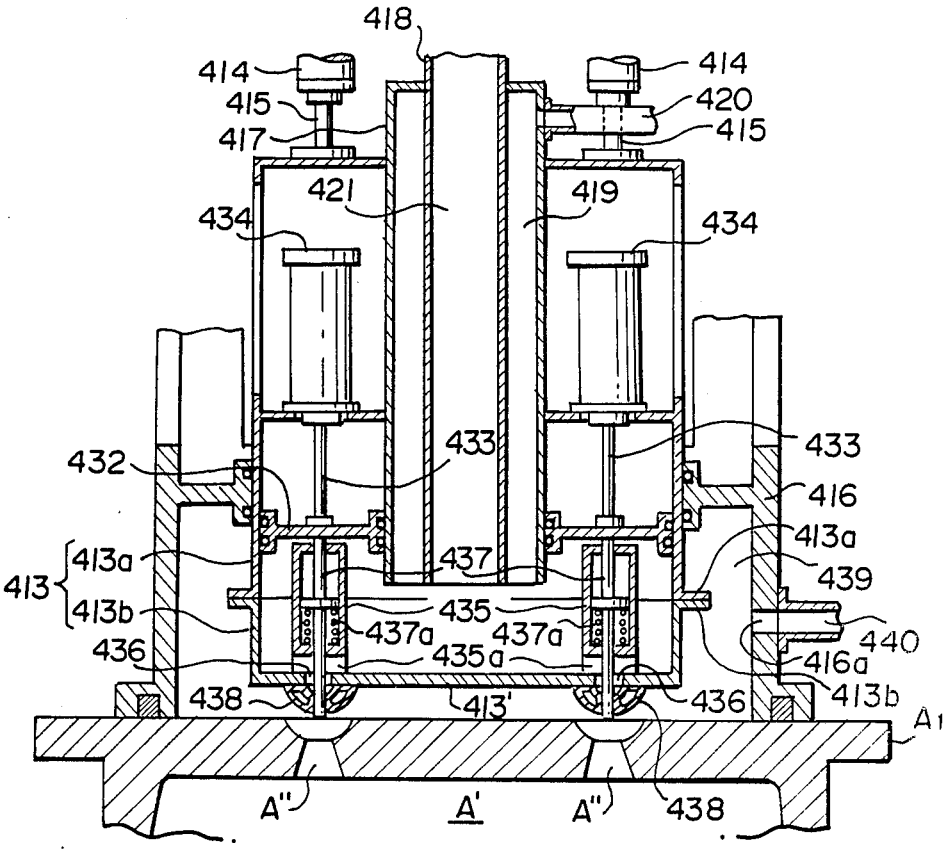
FIG. 21 is a fragmentary cross-sectional view showing the foundry sand blowing apparatus of the seventh embodiment in a state different from the state shown in FIG. 20.

When, with the lower end of the gassing case 416 in close contact with the upper surface of the mold A as shown in FIG. 21, the cylinders 414 are operated to lift the tank 413, thereby lifting the blow tips 438 away from the sand blowing ports A" of the mold A, a gas introduction chamber 439 is defined by the gassing case 416, the outer peripheral surface of the tank 413 and the upper surface of the mold A. The gas introduction chamber 439 is communicated with the cavity A' through the sand blowing ports A" and with a curing catalyst gas supply tube 440 connected to a gas inlet 416*a* formed on a side of the gassing case 416.

The lower half A2 of the mold A is provided in the bottom wall thereof with gas discharge passages 442 for discharging the curing catalyst gas introduced into the cavity A' to a suction passage 441 formed in the mold support table C. Each gas discharge passage 442 is provided at the upper end thereof with a vent plug 443 having a mesh member for preventing leakage of the foundry sand B through the gas discharge passage 442.

Now, the operation of the apparatus in accordance with this embodiment will be described, hereinbelow.

First a desired amount of foundry sand B mixed with binder is introduced into the tank 413 by operating the sand supply mechanism 425 after the valve body 423 is moved to the retracted position, and then the valve body 423 is moved to the closing position to close the upper open end 418*a* of the pipe 418. Thereafter, the cylinders 414 are operated to move the tank 413 to the lower position shown in FIG. 20, where the lower wall 413' of the tank 413 abuts against the upper surface of the mold A, and the blow tips 438 are pressed against the sand blowing port A', whereby the cavity A' of the mold A is communicated with the inner space of the tank 413 by way of the radial holes 435*a*, the sand discharge ports 436, the blow tips 438 and the sand blowing ports A".

Thereafter, pressurized air is introduced into the tank 413 through the air supply tube 420, whereby the foundry sand B in the tank 413 is introduced into the cavity A' under the air pressure to fill the cavity A'. Then the cylinders 434 are operated to move downward the pressure plate 432 to push the eject pins 437 so that the lower end of each eject pin 437 projects outside the blow tip 438, whereby the foundry sand B in the sand discharge port 436 and the blow tip 438 is forced into the sand blowing port A". Then the cylinders 414 are operated to lift the tank 413 with the eject pins 437 projecting outside the blow tips 438, thereby lifting the blow tips 438 away from the sand blowing ports A" as shown in FIG. 21, whereby the gas introduction chamber 439 is formed as described above. Then the curing catalyst gas is introduced through the gas inlet 416*a* into the gas introduction chamber 439 and thus injected into the cavity A', whereby the foundry sand B in the cavity A' is set in a shape conforming to the shape of the cavity A', the product E thus formed being a core in this particular embodiment. Since the outer peripheral surface of the eject pin 437 is in close contact with the inner peripheral surface of the blow tip 438, the curing catalyst gas cannot flow into the tank 413 between the blow tip 438 and the eject pin 437.

Figure 22:
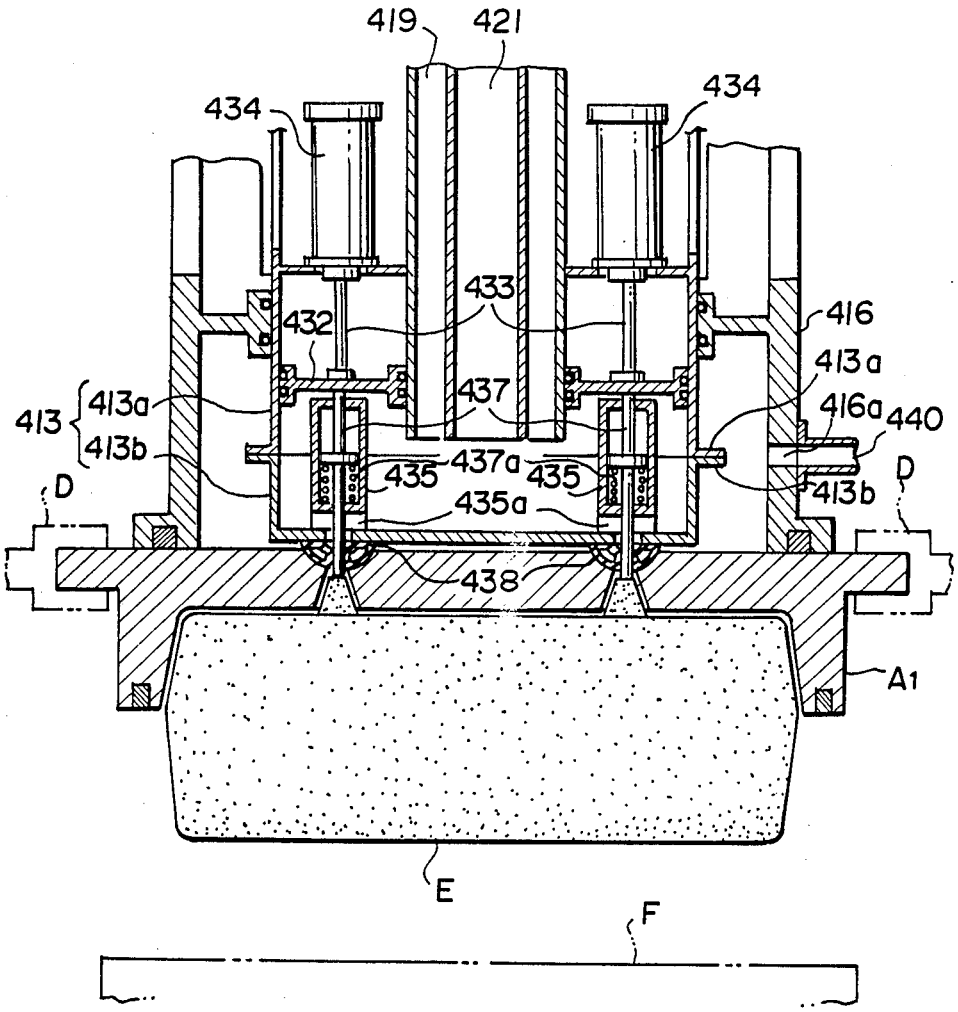
FIG. 22 is a fragmentary cross-sectional view showing the foundry sand blowing apparatus of the second embodiment in another state different from the state shown in FIG. 20.
Figure 23:
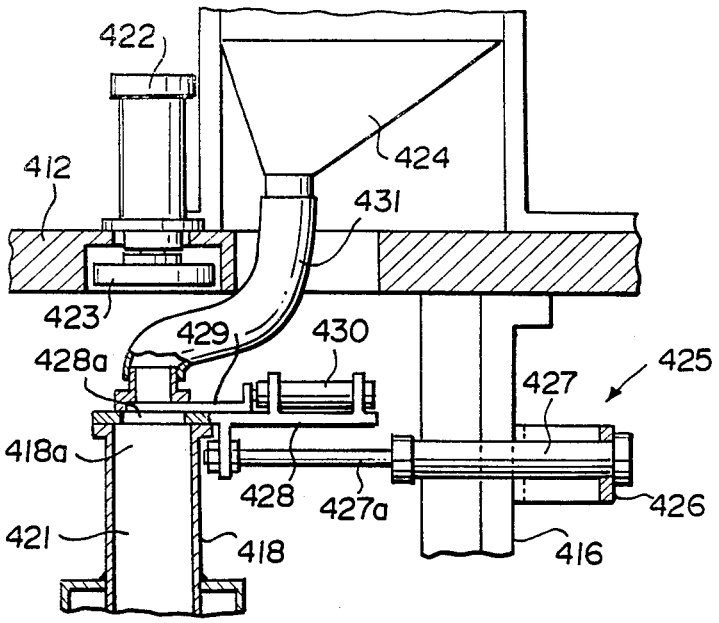
FIG. 23 is a fragmentary cross-sectional view partly broken away showing a part of the apparatus of the seventh embodiment.

After the core E is thus formed in the mold A, supply of the curing catalyst gas into the gas introduction chamber 439 is interrupted and pressurized air is again introduced into the gas introduction chamber 439 through the gas inlet 416*a* to purge the curing catalyst gas in the gas introduction chamber 439, and the cavity A' of the mold A through the discharge passage 442 and the suction passage 441 into a neutralization tank (not shown). Thereafter, the upper half A1 of the mold A is lifted by separate lifters D and the lower half A2 is lowered together with the support table C to open the mold A as shown in FIG. 22. At this time, the core E formed in the mold A is lifted accompanying the upper half A1. When the cylinders 414 are operated to drive downward the tank 413 so that the blow tips 438 are pressed against the sand blowing ports A', the lower end portions of the eject pins 437 are inserted into the sand blowing ports A' of the upper half A1. Thus, the core E is ejected from the upper half A1 onto a receiving member F placed below the upper half A1.

As can be understood from the description above, in the apparatus 411 of this embodiment, the blowing step of blowing the foundry sand B into the cavity A' of the mold A, the gassing step of introducing the curing catalyst gas into the cavity A' and the ejecting step of removing the product E from the mold A are carried out at a single station without conveying the mold A from one station to another. Further, the curing catalyst gas can be prevented from polluting the environment and from being brought into contact with the foundry sand in the sand storage tank.

Also in this embodiment, change of the mold or change in arrangement of sand blowing ports of the mold can be accomplished by simply changing the lower half 413*b* of the tank 413 without changing the pressure plate 432 and the cylinders 434.

Figure 24:
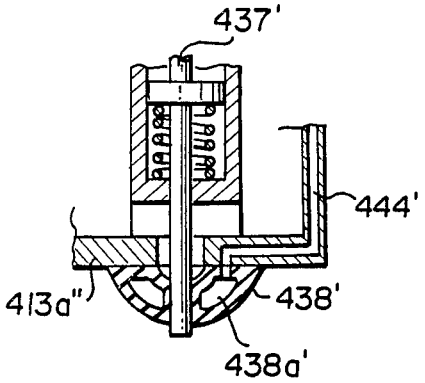
FIG. 24 is an enlarged fragmentary cross-sectional view showing a modification of the blow tip employed in the seventh embodiment.

FIG. 24 shows a modification of the blow tip structure. In FIG. 24, an air passage 444' is formed in the wall of the lower half 413*a*" to be communicated with the inner space 438*a*' of the blow tip 438'. By introducing pressurized air into the inner space 438*a*' through the air passage 444', the internal pressure of the blow tip 438' is enhanced and the sealing effect of the blow tip 438' can be increased. Further, even when the inner peripheral surface of the blow tip 438' is worn due to repeated insertion of the eject pins 437', the inner surface of the blow tip 438' can be constantly pressed against the outer peripheral surface of the eject pin 437' by virtue of the increased inner pressure.

Figure 25:
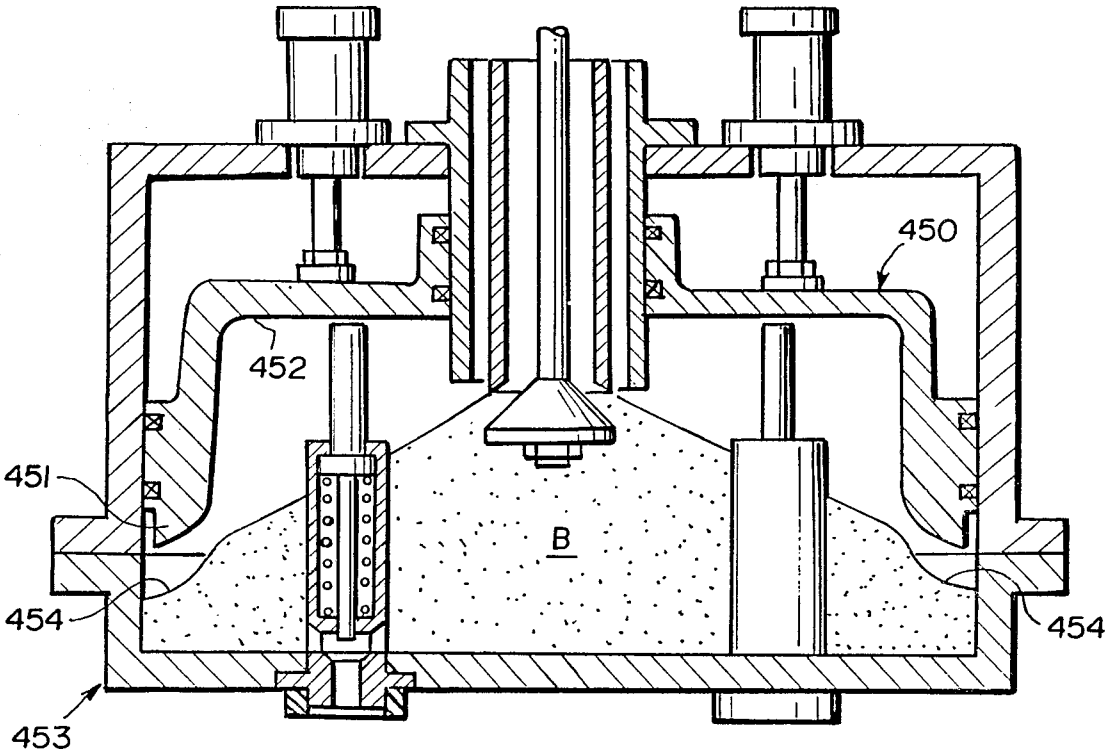
FIG. 25 is a preferred modification of the pressure plate which can be employed in the present invention.

In the embodiments described above, change of the mold or change in arrangement of sand blowing ports of the mold can be accomplished by simply changing the blow head. However, there is a problem that when the blow head is separated, the foundry sand remaining in the blow head is apt to fall from the blow head over the edge thereof. Accordingly, as shown in FIG. 25, it is preferred that the pressure plate 450 be provided with a displacing portion 451 which projects downward from the flat portion 452 of the pressure plate 450 along the edge of the blow head 453. By moving downward the pressure plate 450 before the blow head 453 is separated, a recessed portion 454 is formed along the edge of the blow head 453. By virtue of the recessed portion 454, the sand remaining in the blow head 453 can be prevented from falling from the blow head 453 when the blow head 453 is separated.

We claim:

1. A foundry sand blowing apparatus for blowing foundry sand stored in a sand storage tank into a cavity of a mold through a sand discharge port formed in the sand storage tank wherein the improvement comprises an eject pin provided in the sand storage tank to be movable between a retracted position in which it is retracted in the sand storage tank and an ejecting position in which the lower end portion of the eject pin projects outside the sand storage tank through the sand discharge port, and an eject pin driving means for moving the eject pin between the retracted position and the ejecting position.

2. A foundry sand blowing apparatus as defined in claim 1 in which a plurality of said eject pins are provided in the tank and said eject pin driving means comprises an eject plate for driving the eject pins all together.

3. A foundry sand blowing apparatus as defined in claim 2 in which said eject pins are connected to the eject plate.

4. A foundry sand blowing apparatus as defined in claim 3 in which said foundry sand is of thermosetting type.

5. A foundry sand blowing apparatus as defined in claim 2 in which said eject pins are separate from the eject plate.

6. A foundry sand blowing apparatus as defined in claim 5 in which said sand storage tank comprises upper and lower halves, and said eject pins are supported on the lower half and the eject plate is supported on the upper half.

7. A foundry sand blowing apparatus as defined in claim 6 in which said eject plate is provided with a displacement portion for forming a recess in the foundry sand along the inner peripheral edge of the lower half.

8. A foundry sand blowing apparatus as defined in claim 1 in which a plurality of said eject pins are provided in the sand storage tank, and said eject pin driving means comprises a fluid pressure supply means which includes a fluid passage through which fluid pressure acts on each eject pin to drive it.

9. A foundry sand blowing apparatus as defined in claim 1 in which said eject pin is moved under the guidance of a tubular guide member disposed in the sand storage tank.

10. A foundry sand blowing apparatus as defined in claim 9 in which said tubular guide member is provided with a passage which is communicated with the sand discharge port and is inclined at an angle of repose.

11. A foundry sand blowing apparatus as defined in claim 1 in which said sand storage tank is provided with a sand supply pipe substantially at the center thereof.

12. A foundry sand blowing apparatus as defined in claim 1 in which said sand storage tank is provided with a sand supply pipe on one side thereof.

13. A foundry sand blowing apparatus as defined in claim 12 in which said sand storage is adapted to be swung.

14. A foundry sand blowing apparatus as defined in claim 1 further comprising a gas introduction chamber which is provided on the upper portion of said storage tank and is separated from the inner space of the tank by a partition wall, and an elastic nozzle tip mounted on the lower surface of the tank to circumscribe the sand discharge port and adapted to be pressed against a sand blowing port formed in the mold, said eject pin being in the form of a tubular nozzle the upper end of which projects into the gas introduction chamber through the partition wall and the lower end of which is positioned in the tank opposed to the sand discharge port, the tubular nozzle being normally urged upward by a resilient means to be spaced from the sand discharge port, said eject pin driving means comprising a pressure plate adapted to force the nozzle into the nozzle tip overcoming the force of the resilient means, the nozzle tip being arranged so that when the nozzle is force into the nozzle tip, the inner peripheral surface of the nozzle tip is brought into close contact with the outer surface of the nozzle.

15. A foundry sand blowing apparatus as defined in claim 1 further comprising an elastic blow tip mounted on the lower surface of the tank to circumscribe the sand discharge port and adapted to be pressed against a sand blowing port formed in the mold, and a gassing case which is fit on the sand storage tank to be movable up and down relative the tank and the lower end of which abuts against the upper surface of the mold to form a gas introduction chamber which is communicated with the cavity of the mold by way of the sand blowing port of the mold when the blow tip is removed away from the sand blowing port, said eject pin being adapted to be inserted into the sand discharge port so that the lower end portion thereof projects outside through the blow tip with the inner peripheral surface of the blow tip being brought into close contact with the outer peripheral surface of the eject pin.

* * * * *